US006912952B1

(12) United States Patent
Landa et al.

(10) Patent No.: US 6,912,952 B1
(45) Date of Patent: Jul. 5, 2005

(54) DUPLEX PRINTING SYSTEM

(75) Inventors: Benzion Landa, Nes-Ziona (IL); Yosef Rosen, Moshav-Sitriya (IL); Aron Shmaiser, Rishon-Lezion (IL); Lior Lewintz, Pardes-Hana (IL); Yevgeny Korol, Rehovot (IL); Alex Feygelman, Petach-Tikva (IL); Alon Gazit, Kfar-Hanagid (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 10/089,645

(22) PCT Filed: Feb. 7, 2000

(86) PCT No.: PCT/IL00/00081

§ 371 (c)(1),
(2), (4) Date: Jul. 30, 2002

(87) PCT Pub. No.: WO01/34396

PCT Pub. Date: May 17, 2001

Related U.S. Application Data

(63) Continuation-in-part of application No. PCT/IL99/00600, filed on Nov. 7, 1999, application No. 09/700,986, filed on Nov. 21, 2000, and application No. 09/701,049, filed as application No. PCT/IL98/00553 on Nov. 11, 1998, now Pat. No. 6,438,352, said application No. 09/700,986, filed as application No. PCT/IL98/00235 on May 24, 1998, now Pat. No. 6,608,979.

(30) Foreign Application Priority Data

| | | |
|---|---|---|
| May 24, 1998 | (WO) | PCT/IL98/00235 |
| Nov. 7, 1999 | (WO) | PCT/IL99/00600 |
| Feb. 6, 2000 | (IL) | 134407 |

(51) Int. Cl.[7] ..... B41F 1/30

(52) U.S. Cl. ..... 101/230; 101/229; 101/231; 101/246; 271/277

(58) Field of Search ..... 101/222, 223, 101/230, 408, 409, 410, 411, 229, 231, 232, 246; 271/277, 196, 204, 205, 206

(56) References Cited

U.S. PATENT DOCUMENTS

| | | | |
|---|---|---|---|
| 3,734,015 | A | 5/1973 | Camis et al. |
| 3,741,643 | A | 6/1973 | Vermeulen et al. |

(Continued)

FOREIGN PATENT DOCUMENTS

| | | |
|---|---|---|
| DE | 196 35 388 | 3/1998 |
| EP | 0 274 989 | 7/1988 |

(Continued)

OTHER PUBLICATIONS

Canon Inc.; JP 53–010441 A; Jan. 30, 1978 & Patent Abstracts of Japan; vol. 002; No. 045 (E–024); Mar. 27, 1978.

(Continued)

*Primary Examiner*—Ren Yan
*Assistant Examiner*—Kevin D. Williams
(74) *Attorney, Agent, or Firm*—Fenster & Company

(57) ABSTRACT

Apparatus for duplex printing comprising: a first impression roller (24) on which a first side of a sheet (22) having a leading edge and a trailing edge is printed referenced to the leading edge; a second impression roller (26) on which a second side of the sheet is printed; and a transport system (20) that removes a printed sheet from the first impression roller (24) and transports it to the second impression roller (26), the transport system comprising a perfector (32) that receives the sheet and grips it along both the leading and trailing edges of the sheet, which perfector turns the sheet over and transfers the sheet trailing edge first towards the second impression roller.

19 Claims, 12 Drawing Sheets

U.S. PATENT DOCUMENTS 3,777,158 A 12/1973 Kamogawa et al.
3,884,146 A * 5/1975 Ruetschle ..... 101/183
4,165,689 A 8/1979 Giuiuzza
4,186,662 A 2/1980 Borneman
4,202,268 A 5/1980 Becker
4,204,471 A 5/1980 Becker
4,204,472 A 5/1980 Borneman
4,240,346 A 12/1980 Landis et al.
4,375,326 A 3/1983 Lang
4,378,734 A 4/1983 Wirz
4,428,667 A 1/1984 Phelps et al.
4,431,303 A 2/1984 Hoffman
4,568,169 A 2/1986 Wada et al.
4,607,940 A 8/1986 Quang
4,621,576 A 11/1986 Wirz
4,639,126 A 1/1987 Bushaw et al.
4,660,825 A * 4/1987 Umezawa ..... 271/276
4,684,238 A 8/1987 Till et al.
4,721,041 A 1/1988 Simeth
4,723,489 A 2/1988 Emrich et al.
4,745,282 A 5/1988 Tagawa et al.
4,791,869 A 12/1988 Furukawa
4,806,079 A 2/1989 Kuhn
4,814,822 A 3/1989 Acquaviva et al.
4,821,643 A 4/1989 Wieland
4,884,794 A 12/1989 Dinatale et al.
4,949,949 A 8/1990 Holmes et al.
4,967,660 A 11/1990 Yamanari et al.
4,974,027 A 11/1990 Landa et al.
5,003,355 A 3/1991 Tanzawa
5,020,788 A 6/1991 Hatano et al.
5,110,159 A 5/1992 Herold et al.
5,170,211 A 12/1992 Haupt et al.
5,385,091 A 1/1995 Cuir et al.
5,439,029 A 8/1995 Becker
5,552,875 A 9/1996 Sagiv et al.
5,598,779 A * 2/1997 Haas et al. ..... 101/230
5,606,913 A 3/1997 Kowalewski
5,615,609 A 4/1997 Hill et al.
5,710,964 A 1/1998 Tombs et al.
5,772,343 A 6/1998 Beretta et al.
5,802,424 A 9/1998 Pernesky et al.
5,837,408 A 11/1998 Parker et al.
5,963,770 A 10/1999 Eakin
6,038,976 A * 3/2000 Helmstadter et al. ..... 101/410
6,059,705 A 5/2000 Ruthenberg et al.
6,072,966 A 6/2000 Matsuo
6,088,565 A 7/2000 Jia et al.
6,098,543 A * 8/2000 Becker et al. ..... 101/410
6,122,468 A 9/2000 Sakamoto et al.
6,144,836 A 11/2000 Umeda et al.
6,185,399 B1 2/2001 Zhao et al.
6,219,516 B1 4/2001 Furst et al.
6,271,937 B1 8/2001 Zuber
6,382,092 B1 5/2002 Van Den Brink et al.
6,412,409 B2 7/2002 Weishew
6,418,847 B1 7/2002 Holecek
6,438,352 B1 * 8/2002 Landa et al. ..... 399/401

FOREIGN PATENT DOCUMENTS

EP 0 311 924 4/1989
EP 0 312 660 4/1989
EP 0 342 704 11/1989
EP 0 435 164 7/1991
EP 0 562 269 9/1993
EP 0 570 786 11/1993
EP 0 615 941 9/1994
EP 0 616 886 9/1994
EP 0 161 522 11/1995
EP 0 861 722 9/1998
FR 2 358 273 2/1978
WO WO 90/04216 4/1990
WO WO 93/01531 1/1993
WO WO 93/04409 3/1993
WO WO 94/23347 10/1994
WO WO 95/10801 4/1995
WO WO 96/17277 6/1996
WO WO 97/07433 2/1997

OTHER PUBLICATIONS

Fuji Photo Film Co. Ltd.; JP 63–094287 A; Apr. 25, 1988 & Patent Abstracts of Japan; vol. 012; No. 331 (P–755); Sep. 7, 1988.

Hitachi Koki Co. Ltd.; JP 03–179470 A; Aug. 5, 1991 & Patent Abstracts of Japan; vol. 015; No. 433 (P–1271); Nov. 5, 1991.

* cited by examiner

DUPLEX PRINTING SYSTEM

RELATED APPLICATIONS

The present application is a U.S. national application of PCT/IL00/00081, filed on Feb. 7, 2000 and is a continuation-in-part of PCT Application No. PCT/IL99/00600, filed on Nov. 7, 1999. The present application is also a continuation-in-part of U.S. application No. 09/700,986, filed on Nov. 21, 2000 now U.S. Pat. No. 6,608,979, which is a 371 of PCT/IL98/00235 filed on May 24, 1998 and a continuation-in-part of PCT Application No. PCT/IL98/00553, filed on Nov. 11, 1998; now U.S. application No. 09/701,049, filed on Nov. 22, 2000 now U.S. Pat. No. 6,438,352.

FIELD OF THE INVENTION

The invention relates to printing systems and in particular to duplex printing systems for printing images on one or both sides of a sheet.

BACKGROUND OF THE INVENTION

Duplex printers and sheet transport systems for duplex printers that print both sides of a sheet and reference printing on each side of a sheet to a same edge of the sheet are known.

PCT application PCT/IL98/00553, which is incorporated herein by reference, describes a sheet transport system for a duplex printer that prints both sides of a sheet on a same impression roller. The publication also describes a sheet transport system for a tandem duplex printer that prints each sides of a sheet on a different impression roller.

The transport system, hereinafter referred to as a "re-feed transport system", for the printer that prints both sides of the sheet on a same impression roller receives a sheet from the impression roller after a first side of the sheet is printed. If the second side of the sheet is to be printed, it turns the sheet over and feeds it back to the impression roller for printing the second side. The position of the sheet on the impression roller when the sheet's second side is being printed is registered to the position of the sheet's leading edge. If the second side of the sheet is not to be printed, the transport system moves the sheet to an output tray.

The transport system comprises a sheet transporter and a conveyor belt. The sheet transporter, hereinafter referred to as a "perfector", operates to turn the sheet over and register the position of sheet on the impression roller to the leading edge of the sheet. The perfector comprises a first and second set of vacuum pick up arms. Each of the arms of the first set of arms is mounted to a same shaft and rotate with the shaft. Each of the arms of the second set of arms is mounted to an annulus that rotates about the shaft to which the arms of the first set of arm are attached. Each of the annuli is coupled by its own transmission belt to a drive shaft that rotates all the arms of the second set of arm together. The first and second sets of vacuum arms operate sequentially one after the other to repeatedly remove a printed sheet from the impression roller. When removing a sheet from the impression roller, a set of vacuum arms rotates in a direction opposite to the direction of rotation of the impression roller to a hand off position between the perfector and the impression roller. At the hand off position the set of vacuum arms grips the sheet by an edge of the sheet and rolls the sheet off the impression roller. If the sheet is printed on a first side, the edge that is gripped is a leading edge of the sheet, to which edge printing on the first side is referenced. If the sheet being removed from impression roller is to be printed on its second side, the set of vacuum arms places the sheet, printed side face up, on the conveyor and reverses its direction of rotation. Motion of the conveyor belt and the reverse rotation of the set of vacuum arms feed the sheet back to the impression roller trailing edge first. The set of vacuum arms grips the leading edge of the sheet until a gripper on the impression roller grips the trailing edge and the sheet begins to rolls up on the impression roller. As a result, the position of the sheet on the impression roller is registered to the leading edge of the sheet and printing of the second side of the sheet is referenced to the same leading edge to which printing on the first side of the sheet is registered.

PCT application PCT/IL99/00600 filed on 7 Nov. 1999 and entitled "Tandem Printing System with Fine Paper-Position Correction", describes a sheet transport system and a sheet fine position control system for a tandem printer that prints each side of a sheet on a different impression roller. The disclosure of the application is incorporated herein by reference. The described sheet "tandem" transport system described herein is similar to the tandem sheet transport system described in PCT application PCT/IL98/00553.

The transport system of this application transports a sheet from a first impression roller of the printer, on which a first side of the sheet is printed referenced to a leading edge of the sheet, to a second impression roller of the printer, on which a second side of the sheet is printed. The transport system registers a trailing edge of the sheet to the leading edge so that the position of the sheet on the second impression roller is registered with respect to the leading edge. Printing on the second side of the sheet is therefore referenced to the same leading edge to which printing on the first side of the sheet is referenced.

The sheet transport system comprises a plurality of rotating sheet transporters. Each transporter comprised in the transport system comprises a rotatable shaft and preferably at least one array of suction cups that are mounted to the shaft for gripping a sheet. The transporter also preferably comprises at least one surface, hereinafter referred to as a "support surface", for supporting a sheet that is gripped and held by the transporter's suction cups.

The transporters seriatim receive and hand off one to the other a sheet being transported by the transport system from the first impression to the second impression roller. A first transporter, hereinafter referred to as a "picker", functions to remove a sheet from the first impression roller. The picker grips a leading edge of the sheet that it removes from the impression roller and hands off the leading edge to an adjacent transporter, hereinafter referred to as a "perfector". The perfector turns over the sheet that it receives and hands off a trailing edge of the sheet to a next transporter, hereinafter referred to as a "transfer transporter". The transfer transporter in turn hands off the trailing edge of the sheet to a feed roller that feeds the sheet to the second impression roller, which grips the sheet by the trailing edge.

In turning the sheet over, the perfector reverses its direction of rotation between clockwise and counterclockwise rotation and adjusts its speed of rotation so that when the trailing edge of the sheet is handed off to the transfer transporter, the trailing edge is registered to the leading edge. As a result, when the sheet is passed to the second impression roller, the sheet's position on the second impression roller is registered to the leading edge of the sheet, even though the second impression roller grips the sheet by the trailing edge of the sheet.

SUMMARY OF THE INVENTION

An aspect of some preferred embodiments of the present invention relates to providing an improved sheet transport system for a tandem printer that prints both sides of a sheet of a substrate with reference to a same edge of the sheet, wherein each side of the sheet is printed on a different impression roller.

An aspect of some preferred embodiments of the present invention relates to providing a "tandem" sheet transport system comprising an improved perfector.

A tandem sheet transport system, in accordance with a preferred embodiment of the present invention, is similar to the sheet transport system described in the above referenced PCT application PCT/IL99/00600. However, whereas the perfector described in PCT/IL99/00600 grips a sheet that it transports along the sheet's leading edge, a perfector in accordance with a preferred embodiment of the present invention grips a sheet that it transports along both its leading and trailing edges. The perfector preferably comprises two linear arrays of suction cups. One of the arrays grips a leading edge of a sheet that the perfector transports and the other grips the trailing edge of the sheet. The accuracy with which the trailing edge of the sheet is registered to the leading edge of the sheet is thereby improved.

According to an aspect of some preferred embodiments of the present invention, the position of at least one of the suction cup arrays is adjustable. As a result, the perfector and the transport system easily accommodate different size sheets. In some preferred embodiments of the present invention the position of least one suction cup array is manually adjustable. In some preferred embodiments of the present invention controller controls an appropriate actuator or motor to adjust the position of at least one of the suction cup arrays.

According to an aspect of some preferred embodiments of the present invention a sheet transport system comprises at least one fan mounted over the perfector. The fan creates airflow that improves the accuracy of registration of a trailing edge of a sheet being transported by the sheet transport system to the sheet's leading edge.

When the picker in a sheet transport system, in accordance with a preferred embodiment of the present invention, hands off a sheet being transported by the transport system to the perfector a leading edge of the sheet is first gripped by a first suction cup array of the perfector. The sheet then rolls onto the at least one sheet support surface of the perfector and, when the trailing edge of the sheet rolls onto the at least one sheet support surface, the trailing edge is gripped by a second suction cup array of the perfector. In order for the trailing edge of the sheet to be properly aligned and registered to the leading edge it must lie flat on the at least one support surface. In accordance with a preferred embodiment of the present invention, as the sheet rolls onto the perfector's at least one support surface, the fan creates airflow that presses the sheet flat to the at least one support surface. As a result, the alignment of the trailing edge on the at least one support surface with respect to the position of the leading edge on the support surface is improved.

An aspect of some preferred embodiments of the present invention relates to providing an improved re-feed transport system for a duplex printer that prints both sides of a sheet on a same impression roller.

An aspect of some preferred embodiments of the present invention relates to providing a re-feed sheet transport system comprising an improved perfector.

A re-feed sheet transport system, in accordance with a preferred embodiment of the present invention, is similar to the re-feed sheet transport system described in the above referenced PCT application PCT/IL98/00553. The transport system comprises a perfector that removes sheets from the printer's impression roller and if the sheet is to be printed on a second side places the sheet on a conveyor that guides the sheet back to the impression roller. The perfector registers a trailing edge of the sheet to its leading edge so that the position of the sheet on the impression roller when the sheet's second side is being printed is registered to the sheet's leading edge. However, the transport system of the present application comprises a perfector having an improved construction.

A perfector in accordance with a preferred embodiment of the present invention comprises first and second interleaved rotary arms that rotate about a common axis of rotation. Each rotary arm, hereinafter referred to as a "pick and place" arm, preferably comprises a linear array of suction cups and at least one support surface. The first and second pick and place arms operate to remove sheets from the impression roller after they are printed similarly to the way in which the first and second sets of vacuum pick-up arms of the perfector descried in PCT application PCT/IL98/00553 operate.

Each pick and place arm rotates to a pick off position between the perfector and the impression roller at which position it grips an edge of a sheet being printed. If a sheet removed by a pick and place does not require printing on a second side, the pick and place hands off the sheet to an adjacent transporter that moves the sheet towards an output tray. If the sheet requires printing on a second side, the edge of the sheet that the pick and place grips at the pick off position is a leading edge of the sheet and the pick and place places the sheet on the moving conveyor belt, printed surface face up. The pick and place arm then reverses its direction of rotation and together with the conveyor belt guides the sheet back to the impression roller, trailing edge first, for printing on the second side. The pick and place arm does not release the leading edge until the impression roller grips the trailing edge. The pick and place thereby maintains registration of the trailing edge of the sheet to the leading edge of the sheet. The pick and place arms operate sequentially one after the other to repeatedly pick a printed sheet off the impression roller and place it on the conveyor or hand it off towards the output tray.

When a pick and place removes a sheet from the impression roller, in accordance with a preferred embodiment of the present invention, the sheet rolls off the impression roller and onto the at least one support surface of the pick and place. The at least one support surface contributes to a smooth roll off of the sheet from impression roller and to reducing fluctuations in a force with which the pick and place arm pulls the sheet off the impression roller. The at least one support surface substantially reduces damage to the sheet from kinking or wrinkling of the sheet in regions near to suction cups of the pick and place.

According to an aspect of some preferred embodiments of the present invention a re-feed sheet transport system comprises at least one fan positioned to create airflow that presses the sheet flat to the conveyor belt surface. By pressing the sheet flat to the surface of the conveyor the accuracy with which the trailing edge of the sheet is registered to the leading edge of the sheet is improved.

Proper operation of an transport system in accordance with a preferred embodiment of the present invention requires controlling suction cups on the various transporters so that they suck and release air at appropriate times. The suction cups, which are mounted to rapidly rotating shafts, must therefore be connected to appropriate vacuum pumps and valves.

Methods for transmitting pressure or vacuum to devices mounted to a rotating shaft are known in the art. The devices are connected to appropriate channels in the shaft which in turn are connected to desired vacuum pumps, pressure pumps and valves, hereinafter referred to collectively or individually as "pressure devices".

If one or two channels are needed, a channel is formed at one end or at both ends of the shaft and the end or ends of the shaft are connected to a desired pressure device by a rotary joint. If more than two channels are needed, or more than one channel is needed at a same end of the shaft, in accordance with a preferred embodiment of the present invention, a sealed cavity is formed about the shaft for each channel required. The shaft passes through walls that form the cavity, which are sealed to the shaft using dynamic seals. The dynamic seals allow the shaft to rotate while supporting a pressure differential between one side and the other side of each of the cavity walls through which the shaft passes. The channel is connected to the cavity via a hole that leads from the channel and exits the shaft in a surface region of the shaft located inside the cavity. Pressure or vacuum generated in the cavity is transmitted through the hole to the channel and from the channel to devices connected to the channel. Dynamic seals, such as those known in the prior art generally exert large torque on shafts to which they are coupled and often substantially increase the rate of wear of the shafts. This makes them unsuitable for use in printing systems.

An aspect of some preferred embodiments of the present invention relates to providing dynamic seals that exert relatively small torque on shafts to which they are coupled and which do not substantially accelerate wear of the shafts.

In accordance with a preferred embodiment of the present invention a dynamic seal is formed between a rotatable shaft and a wall of a sealed cavity through which the shaft passes by a rotary bearing that couples the shaft to the wall. An inner race of the bearing presses on a seal, preferably an o-ring seal, mounted on the shaft and an outer race of the bearing presses on a similar seal mounted in the wall. The seals between the outer and inner races of the bearing that protect the bearing's rollers from dirt, and the o-ring seals between the bearing races and the wall support a pressure differential between one side and the other side of the wall. Preferably, the bearings are contact sealed bearings. Contact sealed bearings have seals that are fixed to one of the races of the bearing and make sliding contact with the other race of the bearing. Such bearings are manufactured for example by SKF Ltd. and NSK Ltd. The inventors have found that sealed bearings "2RS" sold by SKF and sealed bearings "DDU" sold by NSK provide a relatively good low pressure gas seal. The inventors have found that a dynamic seal, when used to control aspiration of suction cups in tandem transport system, in accordance with a preferred embodiment of the present invention, satisfactorily supports a pressure differential of 0.8 atmospheres with relatively low air leakage from one side to the other of the seal. Such low leakages are not detrimental to the operation of the system.

There is therefore provided, in accordance with a preferred embodiment of the present invention, an apparatus for duplex printing comprising: a first impression roller on which a first side of a sheet having a leading edge and a trailing edge is printed referenced to the leading edge; a second impression roller on which a second side of the sheet is printed; and a transport system that removes a printed sheet from the first impression roller and transports it to the second impression roller, the transport system comprising a perfector that receives the sheet and grips it along both the leading and trailing edges of the sheet, which perfector turns the sheet over and transfers the sheet trailing edge first towards the second impression roller.

Preferably, the perfector transfers the sheet with the trailing edge registered to the leading edge.

Additionally or alternatively, the perfector comprises a first array of suction cups that grips the sheet adjacent the leading edge and a second array of suction cups that grips the sheet adjacent the trailing edge. Preferably, the distance between the first and second suction cup arrays is adjustable to accommodate different size sheets.

Additionally or alternatively, the perfector comprises a shaft to which the arrays of suction cups are mounted. Preferably, the first and second arrays of suction cups are respectively connected via first and second internal channels in the shaft to at least one vacuum system that controls aspiration of suction cups in the arrays. Preferably, the first and second channels respectively have first and second orifices on the surface of the shaft and wherein the first orifice is displaced from the second orifice along the axis of the shaft. Preferably, the apparatus comprises first, second and third annular bearings mounted to the shaft, wherein each bearing has an inner and outer race that sandwiches a plurality of rollers and at least one seal between the inner and outer race. Preferably the first orifice is located between the first and second bearings and the second orifice is located between the second and third bearings.

The apparatus preferably comprises a seal between the shaft and the inner race of each bearing.

Preferably, the apparatus comprises a housing mounted on the bearings, the housing having a housing wall formed with first and second through holes and having a cavity defined by a cavity surface, and wherein the first through hole is located between the first and second bearings and the second through hole is located between the second and third bearings. Preferably, the apparatus comprises a seal between the outer race of each bearing and the cavity wall.

Preferably, the first and second through holes are connected to the at least one vacuum system via first and second pressure hoses respectively and wherein the suction cups of the first and second suction cup arrays aspirate when the at least one vacuum system respectively draws air through the first and second pressure hoses.

In some preferred embodiments of the present invention the annular bearings are contact sealed bearings.

In some preferred embodiments of the present invention the perfector comprises at least one sheet support surface on which the sheet lies when it is held by the perfector. Preferably, the apparatus comprises a fan that creates airflow that presses the sheet flat to the at least one sheet support surface.

There is further provided, in accordance with a preferred embodiment of the present invention a dynamic seal for providing a gas seal between a shaft and a surface that enables the shaft to rotate with respect to the surface comprising: a contact sealed bearing comprising rollers sandwiched between an inner race and an outer race and a seal between the inner and outer races that protects the rollers from dirt; a gas seal between the inner race and the shaft; and a gas seal between the outer race and the surface.

There is further provided, in accordance with a preferred embodiment of the present invention, a sheet transport system for a printer that receives a sheet from an impression roller of the printer on which a first side of the sheet is printed referenced to a leading edge of the sheet and if the sheet is to be printed on its second side turns the sheet over and returns the sheet to the impression roller, comprising: a conveyor belt that feeds a sheet placed thereon to the impression roller; a perfector that removes a sheet from the impression roller after a first side of the sheet is printed and if a second side of the sheet is to be printed, places the sheet on the conveyor belt, and if a second side is not to be printed moves the sheet towards a printer output tray, the perfector comprising:

first and second brackets independently rotatable about a same axis;

a plurality of suction cups mounted on each of the first and second brackets;

at least one sheet support surface mounted on each bracket; and a system that rotates the brackets sequentially, one after the other remove printed sheets from the impression roller and either place the sheet on the conveyor or move the sheet towards the output tray.

Preferably, the at least one support surface comprised in a bracket is a relatively long narrow surface defined by a plane curve whose plane is perpendicular to the axis about which the first and second brackets rotate and wherein the radial distance from the axis to a point on the curve decreases as the distance of the point from the bracket increases. Preferably, the at least one support surface of the first bracket is axially displaced from the at least one support surface of the second bracket.

Some preferred embodiments of the present invention comprise a fan that creates an airflow that presses a sheet placed on the conveyor belt to the conveyor belt surface.

There is further provided, in accordance with a preferred embodiment of the present invention apparatus for transmitting vacuum to a device mounted on a rotating shaft comprising: first and second annular bearings mounted to the shaft so that there is a space between the bearings, wherein each bearing has an inner race and an outer race that sandwich a plurality of rollers and at least one seal between the inner and outer races; a seal between the inner race of each bearing and the shaft; a housing having a housing wall formed with a through hole, said housing wall forming together with said bearings a cavity that surrounds the shaft and communicates with said through hole; a seal between the housing wall and the outer race of each bearing; wherein said shaft is formed with an internal channel having a first aperture opening that communicates with said cavity and a second aperture communicating with said device.

Preferably the apparatus comprises a source of vacuum that communicates with the through hole to produce a vacuum in the cavity and thereby to transmit vacuum to the device.

Preferably, the apparatus comprises a third annular bearing that forms together with the second bearing and the housing wall an additional cavity that surrounds the shaft, wherein the bearing has an inner race and an outer race that sandwich a plurality of rollers and at least one seal between the inner and outer races. Preferably the apparatus comprises a seal between the inner race of the third bearing and the shaft. Preferably the apparatus comprises a seal between the outer race of the third bearing and the hosing wall.

In some preferred embodiments of the present invention the housing wall is formed with an additional through hole that communicates with the additional cavity. Preferably, the shaft is formed with an additional internal channel that communicates with the additional cavity and with an additional device mounted to the shaft.

Preferably, the vacuum system communicates with the through hole and the additional through hole to control vacuum in the cavity and the additional cavity independent of each other and thereby to independently control vacuum transmitted to the device and the additional device.

In some preferred embodiments of the present invention at least one of the seals is an o-ring seal.

In some preferred embodiments of the present invention the pressure attained in the vacuum transmitted to the device and the additional device is less than 0.03 atmospheres.

In some preferred embodiments of the present invention the bearings are contact sealed bearings.

BRIEF DESCRIPTION OF FIGURES

The invention will be more clearly understood from the following description of preferred embodiments thereof read with reference to figures attached hereto. In the figures, identical structures, elements or parts that appear in more than one figure are generally labeled with the same numeral in all the figures in which they appear. Dimensions of components and features shown in the figures are chosen for convenience and clarity of presentation and are not necessarily shown to scale. The figures are listed below.

DETAILED DESCRIPTION OF PREFERRED EMBODIMENTS

Figure 1A:
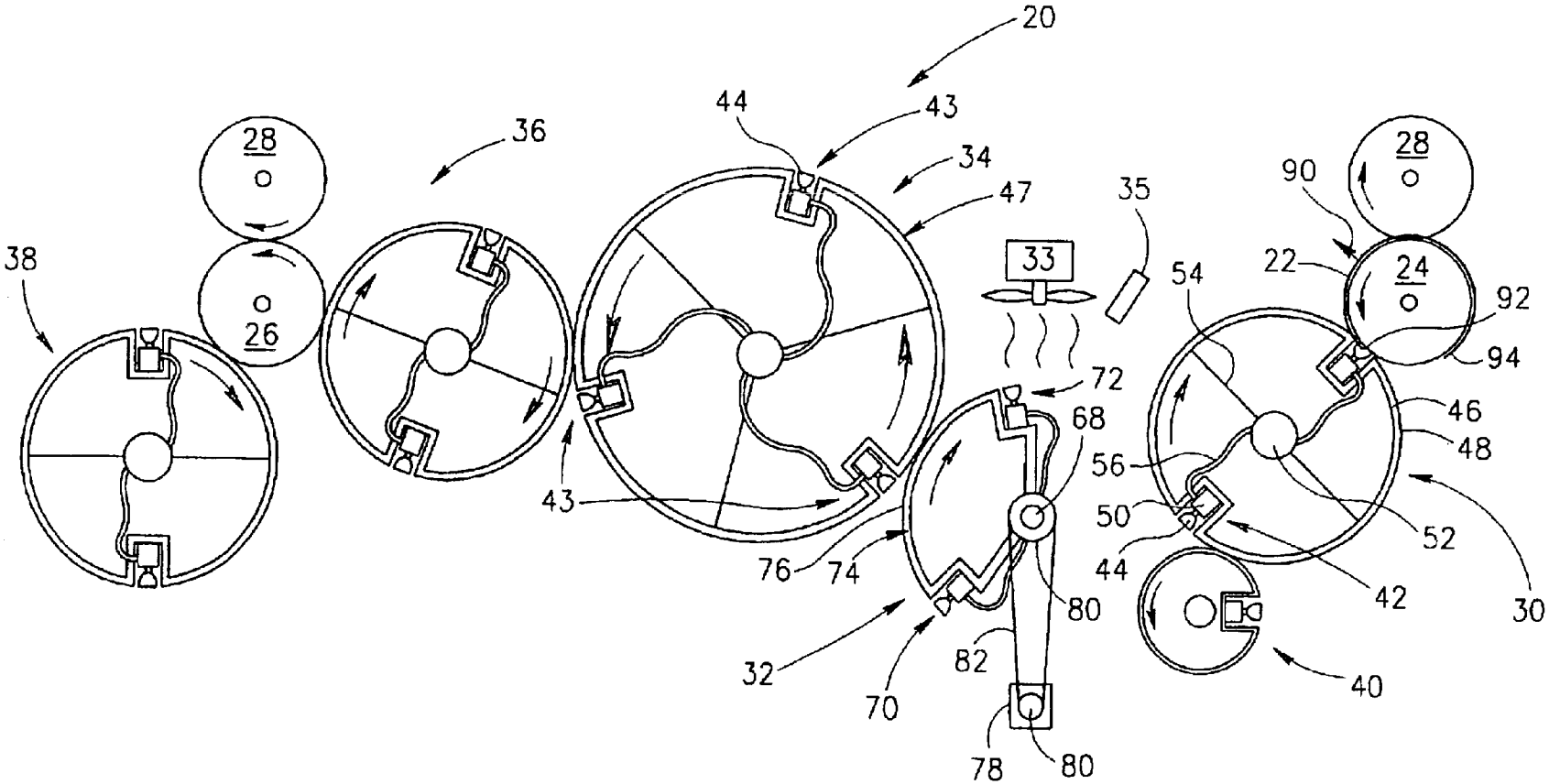
FIGS. 1A and 1D–1I schematically show in cross-sectional view a tandem perfector transport system removing a sheet from a first impression roller of a printer, turning the sheet over and transporting the sheet to a second impression roller of the printer, in accordance with a preferred embodiment of the present invention.

FIGS. 1A and 1D–1I schematically show side views of a tandem sheet transport system 20 comprised in a tandem printer as the transport system removes a sheet 22 from a first impression roller 24 of the printer, turns the sheet over and feeds the sheet to a second impression roller 26 of the printer, in accordance with a preferred embodiment of the present invention. Only elements of the printer that are required for the discussion of transport system 20 are shown in FIGS. 1A and 1D–1I. Rollers 28 represent any suitable devices in the printer for printing an image on a sheet held by impression rollers 24 and 26. For example, a roller 28 might represent an intermediate transfer member or a photoreceptor roller of an electrographic printing engine. For clarity of discussion it is assumed that rollers 28 represent intermediate transfer members. Direction of rotation of impression rollers 24 and 26 and intermediate transfer members 28 are shown by arrows.

Referring to FIG. 1A, sheet transport system 20 preferably comprises a picker transporter 30, a perfector 32, a transfer transporter 34, a feed transporter 36 and a second picker transporter 38. Preferably, sheet transport system 20 comprises at least one fan 33 positioned over perfector 32, which blows air in the direction of the perfector. Preferably, transport system 20 comprises an edge sensor 35 that senses positions of a leading edge and a trailing edge of a sheet that is transported by the transport system at times during which the sheet is located on the perfector. Preferably transport system 20 also comprises a by-pass transporter 40. By-pass transporter 40 is used when it is desired to transport sheet 22 to second impression roller 26 without turning sheet 22 over. By-pass transporter 40 does not function in the transportation of sheet 22 to impression roller 26 shown in FIGS. 1A–1G. The operation of by-pass transporter 40 is discussed below and schematically illustrated in FIGS. 2A–2C. Picker 30 and perfector 32, which are shown in the side view of transport system 20 in FIGS. 1A and 1D–1G, are shown in perspective views in FIGS. 1B and 1C respectively.

In FIG. 1A and figures that follow, to prevent clutter of the figures, unless required for clarity, generally only one feature of a plurality of features that are referred to by a same numeral is labeled by the numeral.

Picker 30, preferably comprises two linear arrays 42 of suction cups 44 and preferably two rim structures 46 that form two sheet support surfaces 48. In the side view of transport system 20 shown in FIGS. 1A–1G only one suction cup 44 of a linear suction cup array 42 and only one rim structure 46 is shown. Suction cups 44 in an array 42 are mounted to a manifold 50. Rim structures 46 are preferably connected to a shaft 52 via spokes 54, only one of which is labeled with a numeral. Manifolds 50 are mechanically coupled to shaft 52 by preferably being mounted to rim structures 46.

Manifold 50 of each suction cup array 42 is preferably connected via a pressure hose 56 to a preferably different "vacuum" channel (not shown) in shaft 52. The vacuum channels are coupled to an appropriate vacuum system that is controlled by a controller (not shown). The controller controls the vacuum system so that suction cups 44 of each suction cup array 42 suck and release air to respectively grip and release a sheet being transported by transport system 20 at appropriate times.

In some preferred embodiments of the present invention the "vacuum" channels in shaft 52 to which manifolds 50 are coupled are connected to the vacuum system using conventional techniques and conventional devices, such as rotary joints and conventional dynamic seals. Preferably, the channels are connected to the vacuum system using dynamic seals in accordance with a preferred embodiment of the present invention that are discussed below and schematically shown in FIG. 3.

Figure 1B:
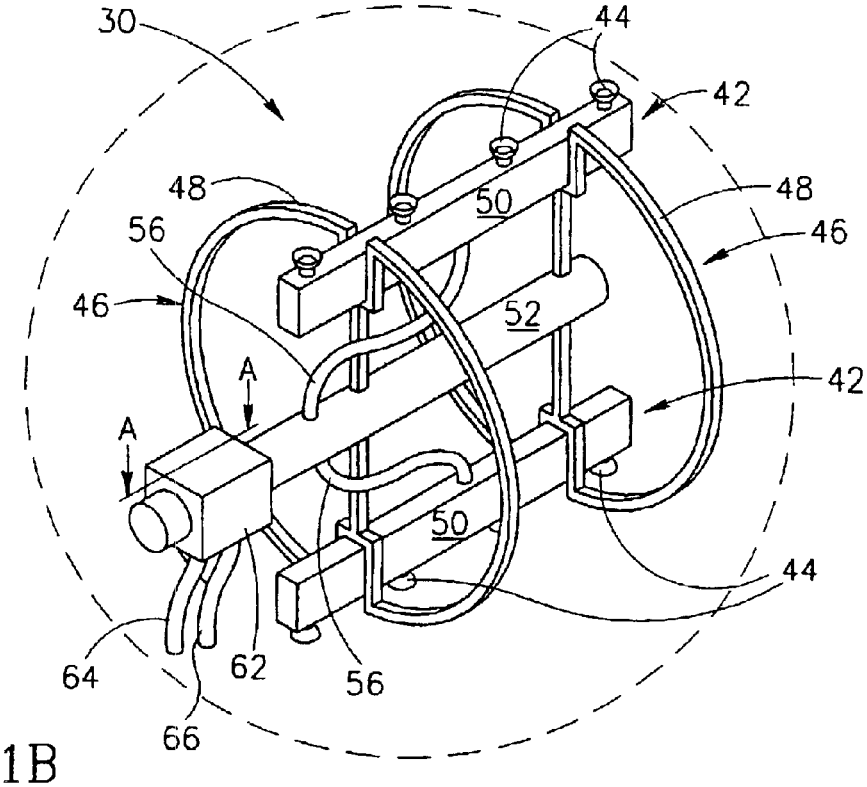
FIGS. 1B and 1C schematically show perspective views of a picker and a perfector comprised in the transport system shown in side views in FIGS. 1A and 1D–1I.
Figure 3:
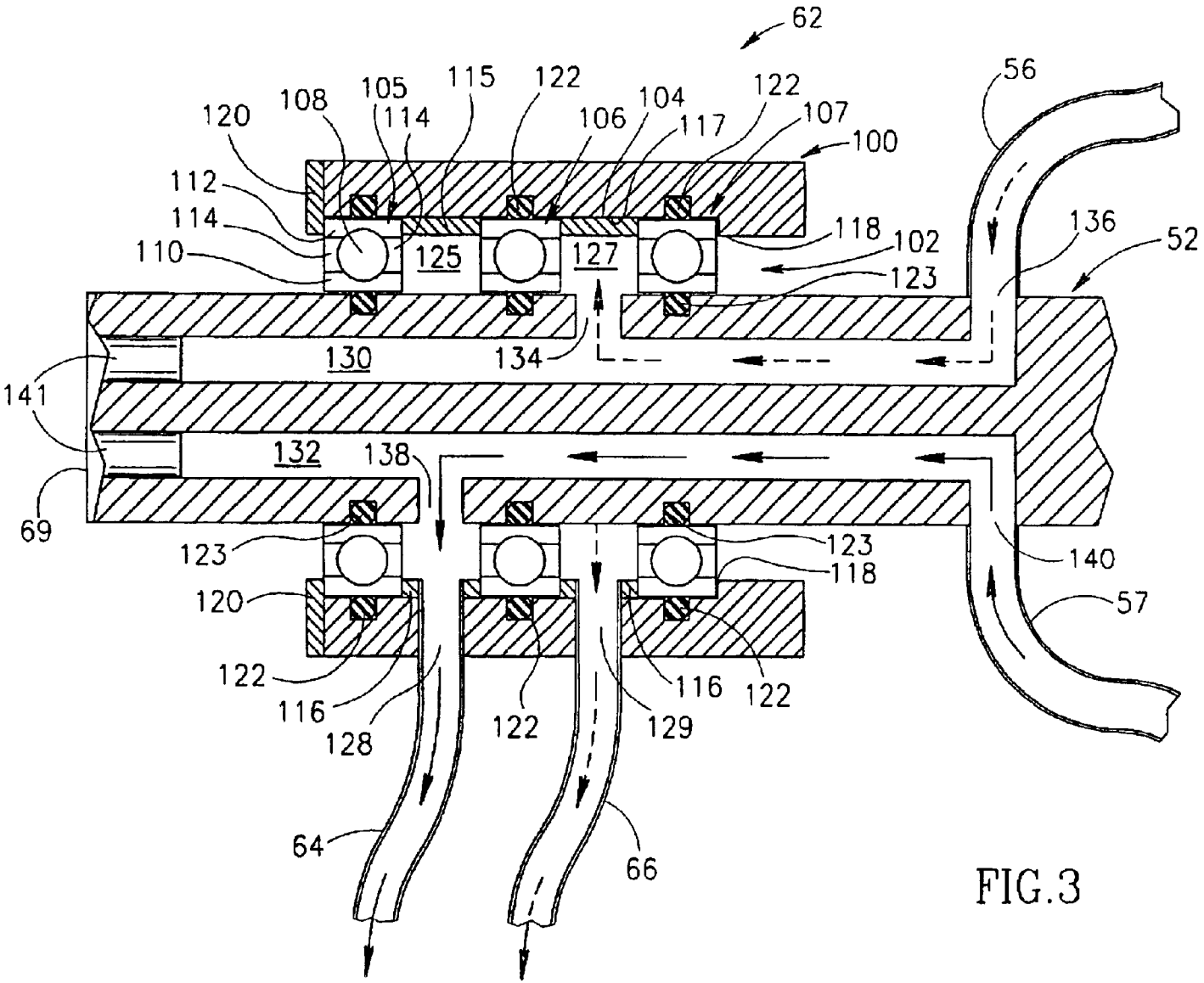
FIG. 3 schematically shows dynamic seals used to couple a vacuum pump to suction cups of a transporter, in accordance with a preferred embodiment of the present invention FIG. 4 schematically shows in perspective view a perfector transporter comprising two pick and place arms, in accordance with a preferred embodiment of the present invention.

The perspective view of picker 30 shown in FIG. 1B shows a vacuum distributor 62, which is mounted near an end 63 of shaft 52, that comprises a sealed cavity (not shown) for each vacuum channel in shaft 52 (there are two vacuum channels in shaft 52). Each cavity couples a different one of the vacuum channels to the vacuum system via a different one of pressure hoses 64 and 66. The cavities in vacuum distributor housing 62, are preferably sealed using dynamic seals (not shown), in accordance with a preferred embodiment of the present invention. Details of internal features of vacuum housing 62 are shown in FIG. 3 and discussed in the discussion of FIG. 3.

Returning to FIG. 1A transfer transporter 34, feed transporter 36 and second picker 38 preferably have a construction similar to that of picker 30. Each of these transporters preferably rotate with a constant rotational speed in a direction indicated by the arrows inside the transporter. Feeder 36 and second picker 38 are preferably identical to picker 30. Transfer transporter 34 is preferably larger than picker 30 and preferably comprises three linear arrays 43 of suctions cups 44 and two rim structures 47.

In a preferred embodiment of the present invention the relative diameters of transfer transporter 34, picker 30 (and picker 38 and feeder 36) and impression roller 24 (and 26) are about 3:2:1. Preferably each of these transporters and impression roller rotates with a substantially constant angular velocity.

Figure 1C:
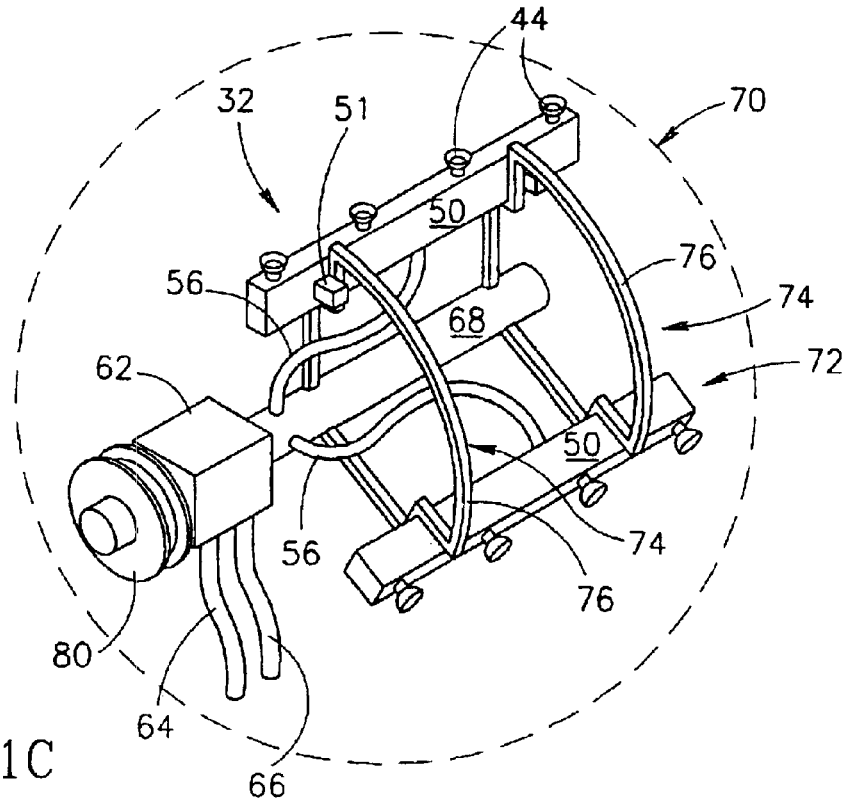

Their relative angular velocities are preferably inversely proportional to their diameters. Perfector 32, shown also in perspective view in FIG. 1C, preferably comprises a shaft 68, arrays 70 and 72 of suction cups 44 connected to manifolds 50 and "sector rim structures" 74 that form sheet support surfaces 76. Manifolds 50 are preferably mounted to sector rim structures 74. Preferably, the positions of at least one of manifolds 50 is adjustable so that a distance between suction cup arrays 70 and 72 can be adjusted to accommodate different size sheets. In some preferred embodiments of the present invention a manifold 50 is adjusted manually. In some preferred embodiments of the present invention the position of a manifold 50 is adjusted using small actuators or motors. FIG. 1C schematically shows two actuators 51 mounted sector rim frames 74 to adjust the position of one of manifolds 50. Each manifold 50 is connected to a different vacuum channel (not shown) in shaft 68 via a pressure hose 56. Similarly to the other transporters in transport system 20, the vacuum channels are appropriately connected to a vacuum system, preferably via a vacuum housing 62.

Rim structures 74 of perfector 32 are constructed substantially different from the rim structures of other transporters in sheet transport system 20. Sheets transported by perfector 32 are always located between suction cup arrays 70 and 72. As a result a full rim structure is not required for perfector 32. In addition, unlike the other transporters in transport system 20, which move with substantially a constant rotational velocity, perfector 32 accelerates and decelerates relatively rapidly and changes direction or rotation when transport system 20 turns over a sheet that it transports between impression rollers 24 and 26. The "sector structure" of sector rim structures 74 results in a rim structure substantially less massive than a "full" rim structure. The lighter mass of sector rim structures 74 facilitates accelerating perfector 32 rapidly. Perfector 32 is preferably driven by a motor 78, which is connected to shaft 68, preferably, by pulleys 80 and a transmission belt 82. Preferably, transmission belt 82 is a timing belt and pulleys 80 are splined pulleys. The controller controls motor 78 to provide desired motion of perfector 32. Preferably, the controller controls motor 78 responsive to signals that it receives from edge sensor 35 and from an encoder (not shown) that monitors the position of second impression roller 26. The signals are preferably used to adjust rotational speed of perfector 32 to adjust transport system 20 for variance in the length of sheets transported by the system and errors in the position of a sheet held by perfector 32. Adjusting the rotational velocity of perfector 32 to accommodate errors in the position of a sheet transported by a sheet transport system similar to that described in the present application is discussed in PCT application PCT/IL99/00600 referenced above. PCT/IL99/00600 also describes a system useable for fine tuning the position of a sheet immediately prior to its being fed to second impression roller 26. In some preferred embodiments of the present invention, sheet transport system 20 comprises a sheet position fine tuning system similar to that described in PCT/IL99/00600. The direction of rotation of perfector 32 in FIGS. 1A and 1D–1G is shown by the direction of the arrow inside the perfector. In FIG. 1A perfector 32 is rotating clockwise.

In FIG. 1A a first side of sheet 22 is shown being printed on impression roller 24. An arrow 90 in FIG. 1A and figures that follow indicate the printed side of sheet 22. Sheet 22 has a leading edge 92 and a trailing edge 94. Printing on the first side of sheet 22 is referenced to leading edge 92. Impression roller 24 is rotated to a position at which leading edge 92 is located at a hand off position between impression roller 24 and picker 30. Picker 30 is rotated so that one of its suction cup arrays 42 is also at the pick off position. The vacuum system to which the suction cup array 42 is connected is controlled so that suction cups 44 in the array suck in air and grip sheet 22 along leading edge 92. As picker 30 and impression roller 24 continue to rotate, sheet 22 rolls off impression roller 24 and onto support surfaces 48 of picker 30. At this stage of moving sheet 22 to second impression roller 26 perfector 32 is rotating clockwise.

Figure 1D:
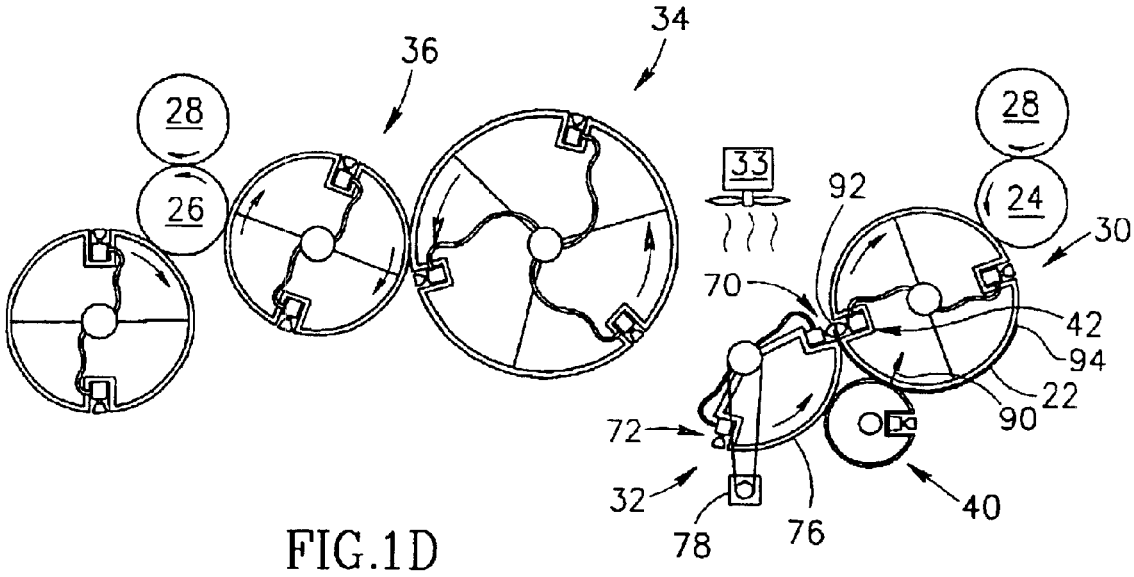

In FIG. 1D perfector 32 and picker 30 have rotated to a sheet hand off position between the picker and the perfector. Suction cup array 70 of perfector 32 is opposite leading edge 92 of sheet 22 and suction cup array 70 aspirates air and grips the leading edge while suction cup array 42 of picker 30 releases the leading edge. In addition, perfector 32, which had been rotating clockwise, is controlled by motor 78 to reverse direction and rotate counterclockwise in synchronism with picker 30.

As picker 30 and perfector 32 continue to rotate, sheet 22 rolls off picker 30 and onto perfector 32. Air blown by fan 33 in the direction of perfector 32 presses sheet 22 firmly to sheet support surfaces 76 of the perfector.

Figure 1E:
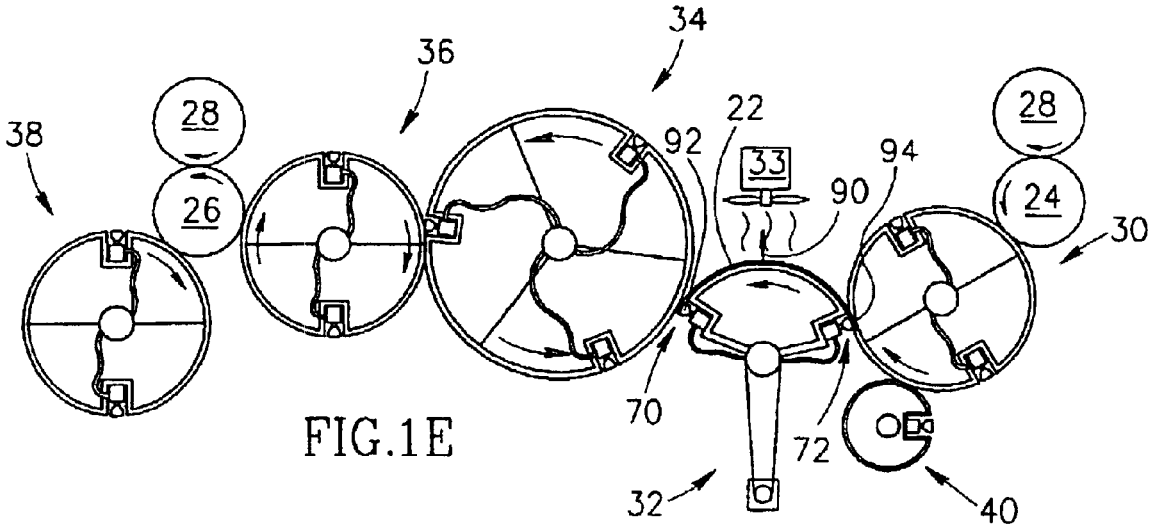

FIG. 1E shows perfector 32 still rotating counterclockwise and rotated to a position at which sheet 22 is completely transferred to perfector 32. Suction cup array 72 of perfector 32 is now opposite trailing edge 94 of sheet 22 and is controlled to aspirate and grip trailing edge 94. Sheet 22 is now firmly held on perfector 32 by both its leading edge 92 and its trailing edge 94 and the position of trailing edge 94 on the perfector is accurately registered to the position of leading edge 92 on the perfector. The printed side of sheet 22 is face up on perfector 32 as indicated by arrow 90.

After securing sheet 22 by its leading and trailing edges, perfector 32 continues rotating counterclockwise until trailing edge 94 is at a hand off position between perfector 32 and transfer transporter 34.

Figure 1F:
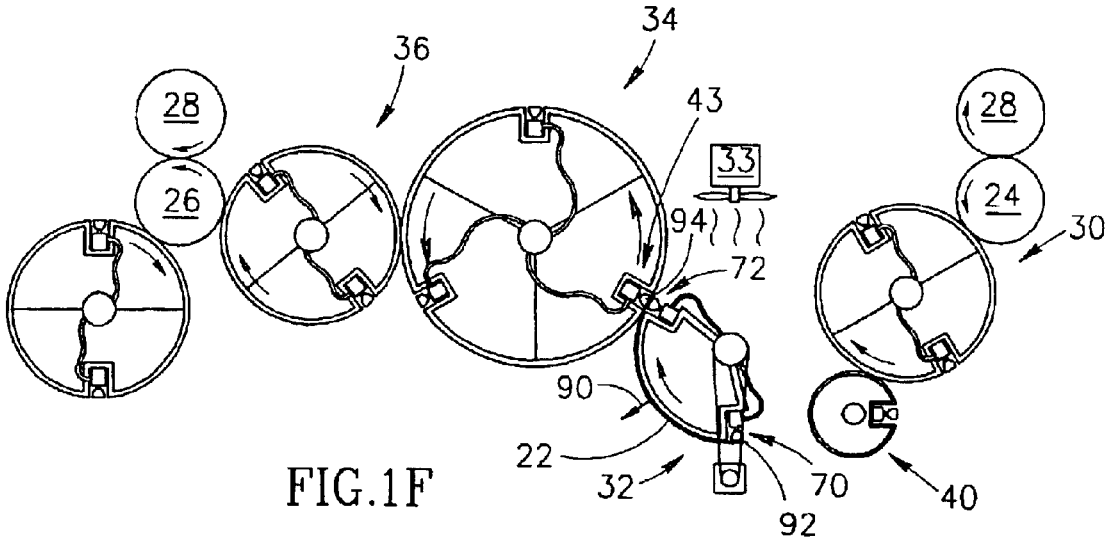

FIG. 1F shows the positions of perfector 32 and transfer transporter at the hand off position. At the hand off position, perfector 32 reverses its direction of rotation and begins to rotate clockwise, to match the counterclockwise rotation of transfer transporter 34 and a suction cup array 43 of transfer transporter 34 grips trailing edge 94. Suction cup array 72 of perfector 32 releases trailing edge 94 and as transfer transporter 34 and perfector 32 continue to rotate, sheet 22 rolls onto transfer transporter 34 and suction cup array 70 of the perfector releases leading edge 92 of sheet 22. Sheet 22 is then completely on transfer transporter 34, held on the transfer transporter by trailing edge 94 and with the printed surface of sheet 22 face down, as indicated by arrow 90.

Even though transfer transporter 34 grips sheet 22 by trailing edge 94, the position of sheet 22 on the transporter is registered to leading edge 92, since perfector 32 handed off trailing edge 94 to transfer transporter 34 with the position of trailing edge 94 accurately registered to the position of leading edge 92. As a result, in further hand-offs between transporters as transport system 20 moves sheet 22 to impression roller 26, which are accomplished by handing off trailing edge 94 of sheet 22, the position of sheet 22 remains registered to leading edge 92.

Figure 1G:
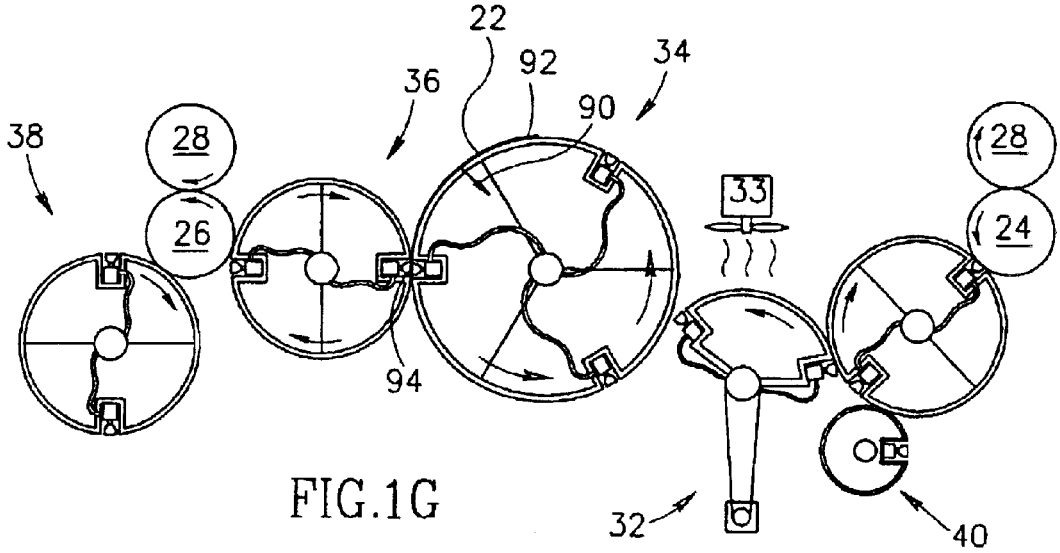
Figure 1H:
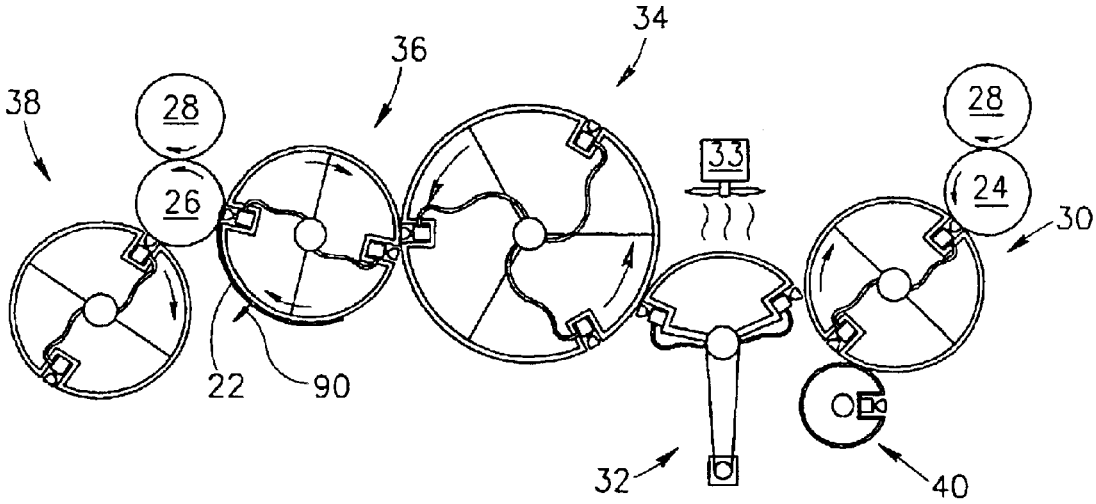
Figure 1I:
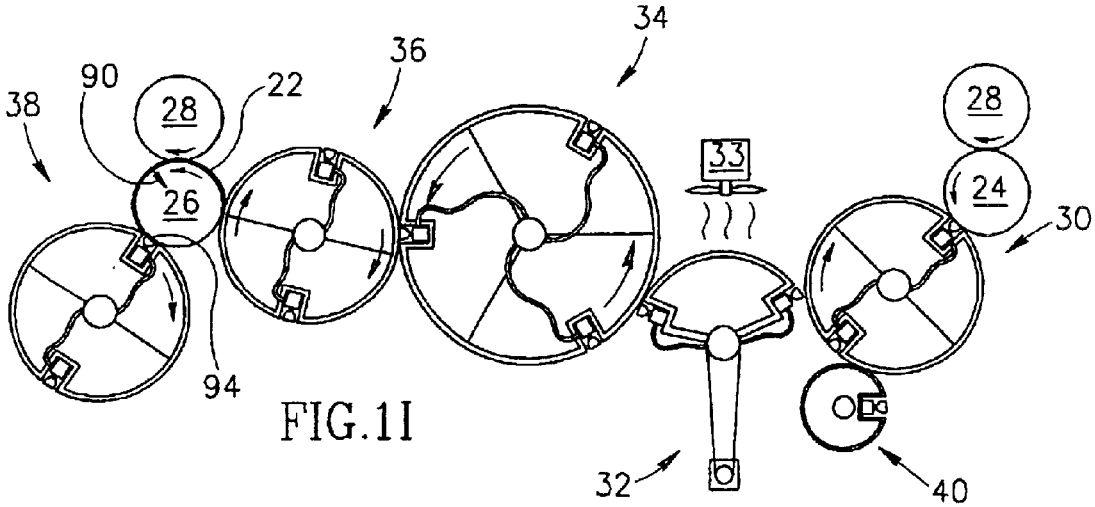

FIG. 1G shows transfer transporter 34 handing off trailing edge 94 (at this point the leading edge) of sheet 22 to feeder 36 and FIG. 1H shows feeder 36 feeding sheet 22 to second impression roller 26 with sheet 22 oriented so that its printed side is down on the impression roller. Preferably, sheet transport system 20 comprises a sheet position fine adjustment system that adjust the timing of the transfer of sheet 22 from feeder 36 to second impression roller 26, as described in PCT application PCT/IL99/00600. FIG. 1I shows second picker 38 gripping trailing edge 94 as the picker begins removing sheet 22 from impression roller 26 after the second side of sheet 22 is printed.

Figure 2A:
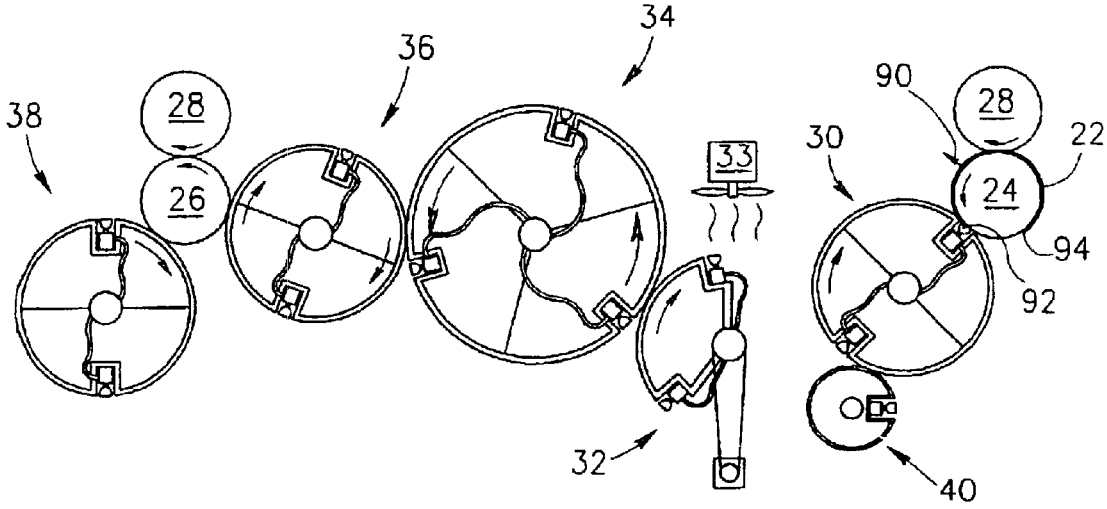
FIGS. 2A–2D schematically show the transport system shown in FIG. 1A transporting a sheet from the first impression roller to the second impression roller without turning the sheet over, in accordance with a preferred embodiment of the present invention.

FIGS. 2A–2D schematically show the operation of transport system 20 when sheet 22 is transported from impression roller 24 to impression roller 26 without turning over sheet 22. FIG. 2A is identical to FIG. 1A and shows picker 30 removing sheet 22 from impression roller 24 after a first side of the sheet is printed. The orientation of the printed side of sheet 22 is shown by arrow 90. Perfector 32 is rotating clockwise.

Figure 2B:
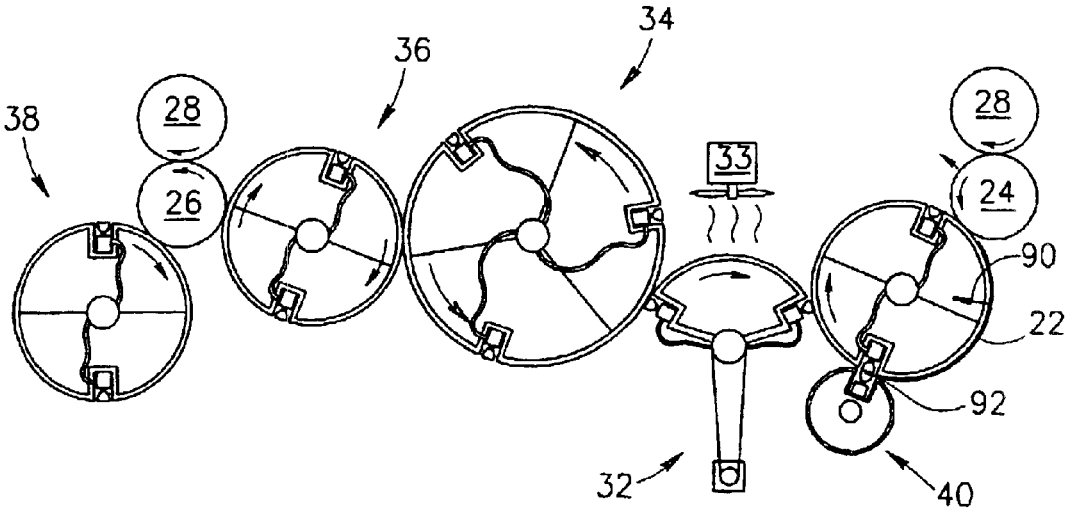
Figure 2C:
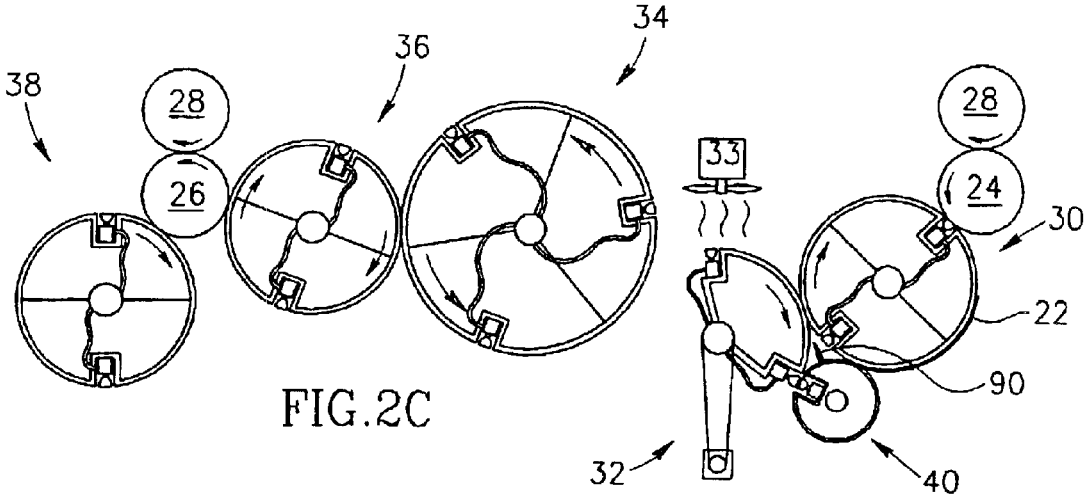
Figure 2D:
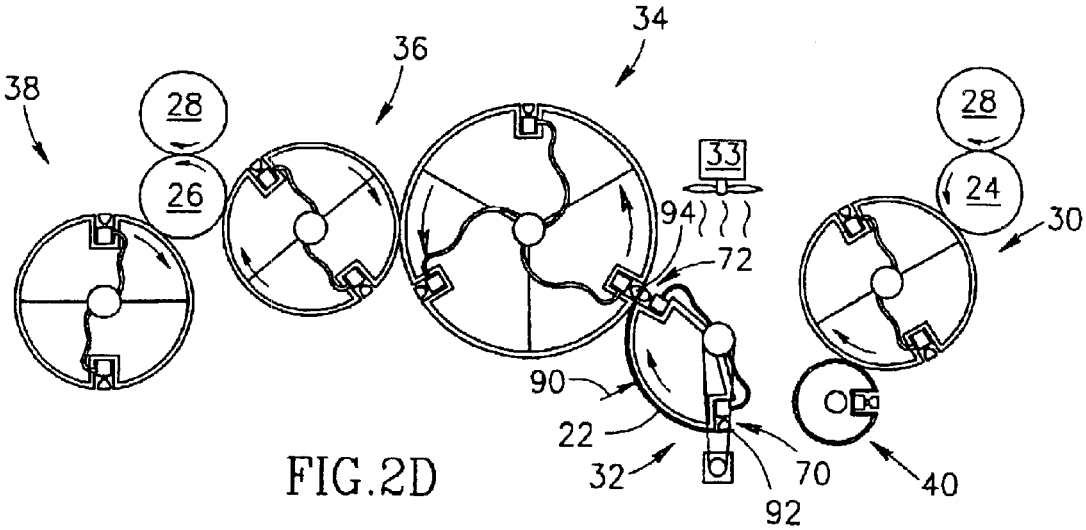

However, unlike the transport process shown in FIGS. 1A and 1D–1I, in the transport process shown in FIGS. 2A–2D, picker 30 does not hand off sheet 22 to perfector 32. Instead, picker 30 hands off sheet 22 to by-pass transporter 40, as shown in FIG. 2B. By-pass transporter 40 then hands off sheet 22 to perfector 32 as shown in FIG. 2C. After receiving sheet 22, perfector 32 does not reverse its direction of rotation but continues rotating clockwise to hand off sheet 22 to transfer transporter 34, as shown in FIG. 2D. As a result, perfector 32 does not turn over sheet 22. From transfer transporter 34, sheet 22 is handed off towards impression roller 26 as shown in FIGS. 1G–1I. However, when sheet 22 is fed to impression roller 26, sheet 22 rolls onto impression roller with the printed side face up, rather than face down as in the sheet transfer process shown in FIGS. 1A and 1D–1I. It should be noted that in the sheet transport process shown in FIGS. 2A–2D sheet 22 is always held by leading edge 92 and transfer of sheet 22 from one transporter to another is always done by handing off leading edge 92. The position of sheet 22 on second impression roller 26 is therefore automatically registered to leading edge 92.

When transfer system 20 is configured to use by-pass transporter 40, the transport system transports sheets substantially more rapidly between impression roller 24 and impression roller 26 than when the system is configured to turn over a page when it transports a sheet between the rollers. Therefore, when the printer comprising transport system 20 is used to print only one side of a sheet, a higher throughput of the printer can be achieved when transport system 20 is configured to use by-pass transporter.

In addition, when the printer is used to print both sides of a sheet, transporter 40 is advantageously used to check color density on both sides of the sheet with a single in-line densitometer. Assume for example that the densitometer is located so that it checks the color density on a sheet while the sheet is on second impression roller 26. Therefore, under normal duplex operation the densitometer checks color density on the second side of the sheet (i.e. the one printed on second impression roller 26). To check color density on the first side of the sheet, transport system 20 is switched to a calibration mode in which the system is configured to use by-pass transporter 40 and the printer is set to print only the first side of the sheet (i.e. the side printed on first impression roller 24). A sheet printed under these conditions when it rolls onto second impression roller 26 has the first side up on the impression roller and the densitometer checks color density on the first side.

FIG. 3 shows a schematic cross-sectional view of a portion of shaft 52 of picker transporter 30, shown in FIG. 1B, which is mounted with vacuum distributor 62, in accordance with a preferred embodiment of the present invention. The cross-sectional view is taken along line A—A shown in FIG. 1B and illustrates a method of transmitting vacuum to suction cup arrays 42 comprised in picker 30 using dynamic seals, in accordance with a preferred embodiment of the present invention.

Vacuum distributor 62 comprises a housing 100 having a circularly cylindrical cavity 102 defined by an inner cavity wall 104 of housing 100. Three preferably identical annular rotary bearings 105, 106 and 107 are mounted inside cavity 102. Preferably bearings 105, 106 and 107 are contact sealed bearings. Each bearing 105, 106 and 107 comprises a plurality of appropriate cylindrical or spherical rollers 108 and an inner race 110 and an outer race 112. Grease seals 114 on either side of rollers 108 protect the rollers from dirt. Preferably To prevent clutter, numerals identifying components of bearing 105, 106 and 107 are shown only for bearing 105.

The outer diameter of bearings 105, 106 and 107 are substantially equal to the diameter of cylindrical cavity 102 and the inner diameters of the bearings are substantially equal to the diameter of shaft 68. An annular spacer 115 is preferably placed between adjacent bearing 105 and 106 to maintain a desired distance between the bearings. Similarly an annular spacer 117 is placed between bearing 106 and 107. Spacers 115 and 117 preferably have an outer diameter substantially equal to the diameter of cylindrical cavity 102 and are preferably press fit into cavity 102 so that once in place they cannot rotate inside the cavity. Spacers 115 and 117 have a radial wall thickness preferably sufficiently thin so that they contact bearings between which they are placed only along outer races 112 of the bearings. A lip 118 in housing 100 and a cover plate 120 preferably secure bearings 106 and spacers 116 inside cavity 102.

For each bearing 105, 106 and 107 an o-ring or other suitable seal 122 is seated in an appropriate groove in inner wall 104 of housing 100 contacts and presses against outer race 112 of the bearing. O-ring 122 provides a gas seal between race 112 of the bearing and cavity wall 104. Similarly, for each bearing 105, 106 and 107 an o-ring or other suitable seal 123 is seated in an appropriate groove in shaft 68 opposite inner race 110 of the bearing. O-ring 123 provides a gas seal between race 112 of the bearing and the surface of shaft 68. For each bearing 105, 106 and 107 grease seals 114 of the bearings and gas seals provided by o-rings 122 and 123 provide a gas seal between shaft 68 and cavity wall 104 that supports a pressure differential between the two sides of the bearing. In addition the bearings and seals enable shaft 68 to rotate freely within vacuum distributor 62. Bearings 105, 106 and 107 and their associated o-ring seals therefore function as low torque dynamic seals and create two separate sealed annular cavities 125 and 127 between shaft 68 and cavity wall 104 of vacuum distributor 62. An inlet hole 128 to cavity 125 passes through housing 100 and spacer 115 and an inlet hole 129 to cavity 127 similarly passes through housing 100 and spacer 117. Inlet holes 128 and 129 are connected via pressure hose 64 and 66 respectively to the vacuum system (not shown) that generates vacuum for suction cup arrays 42 of picker 30.

Shaft 68 is formed with two channels 130 and 132 that are preferably parallel to the axis of shaft 68. Channels 130 and 132 are not connected to each other. Channel 130 has an inlet hole 134 and an outlet hole 136, each of which connects channel 130 with the surface of shaft 68. Inlet hole 134 is located so that it communicates with sealed annular cavity 127. Outlet hole 136 is connected via pressure hose 56 to one of suction cup arrays 42 of picker 30 (FIG. 1B). Channel 132 similarly has an inlet hole 138 and an outlet hole 140. Inlet hole 138 is positioned so that it communicates with annular sealed cavity 125. Outlet hole 140 is connected to the other of suction cup arrays 42 of picker 30 via a pressure hose 57. Channels 130 may be formed for example by drilling appropriate holes through end 69 of shaft 68 and plugging the holes with plugs 141.

Vacuum distributor 62 enables each of suction cup arrays 42 of picker 30 to be controlled independently of each other. When the vacuum system draws air through pressure hose 64 air is drawn through channel 132 and from the suction cups in the suction cup array 42 to which channel 132 is concerted. The direction of air flow through channel 132 and annular cavity 125 when air is drawn through pressure hose 64 is shown by solid arrow. When the vacuum system draws air through pressure hose 66 air is drawn through channel 130 and from the suction cups in the suction cup array 42 to which channel 130 is concerted. The direction of air flow through channel 130 and annular cavity 127 when air is drawn through pressure hose 66 is shown by dashed arrows.

It should be noted that whereas vacuum distributor 62 is shown transmitting vacuum to two channels in shaft 68 a similar vacuum distributor comprising more than three low torque dynamic seals can be used to transmit vacuum to more than two channels in a rotating shaft, in accordance with a preferred embodiment of the present invention. Furthermore, whereas vacuum distributor 62 has been described as transmitting vacuum it can of course also be used to transmit low pressure to channels in a rotating shaft.

It should be noted that inlet hoses 64 and 66 do not rotate with shaft 68 and can thus can be freely connected to a stationary source of vacuum. The vacuum at outlet hoses 56 and 57 rotates and thus can be attached to any structure that rotates with the shaft. Thus, the vacuum at hoses 56 and 57 can be controlled by controlling the vacuum at hoses 64 and 66.

Furthermore, while FIG. 3 shows a two way distributor, an extended structure of the same type (using an rotating seal and channel for each input/output) can be used for any number of channels of vacuum. Furthermore, both sides of the shaft are fitted with distributors.

Figure 4:
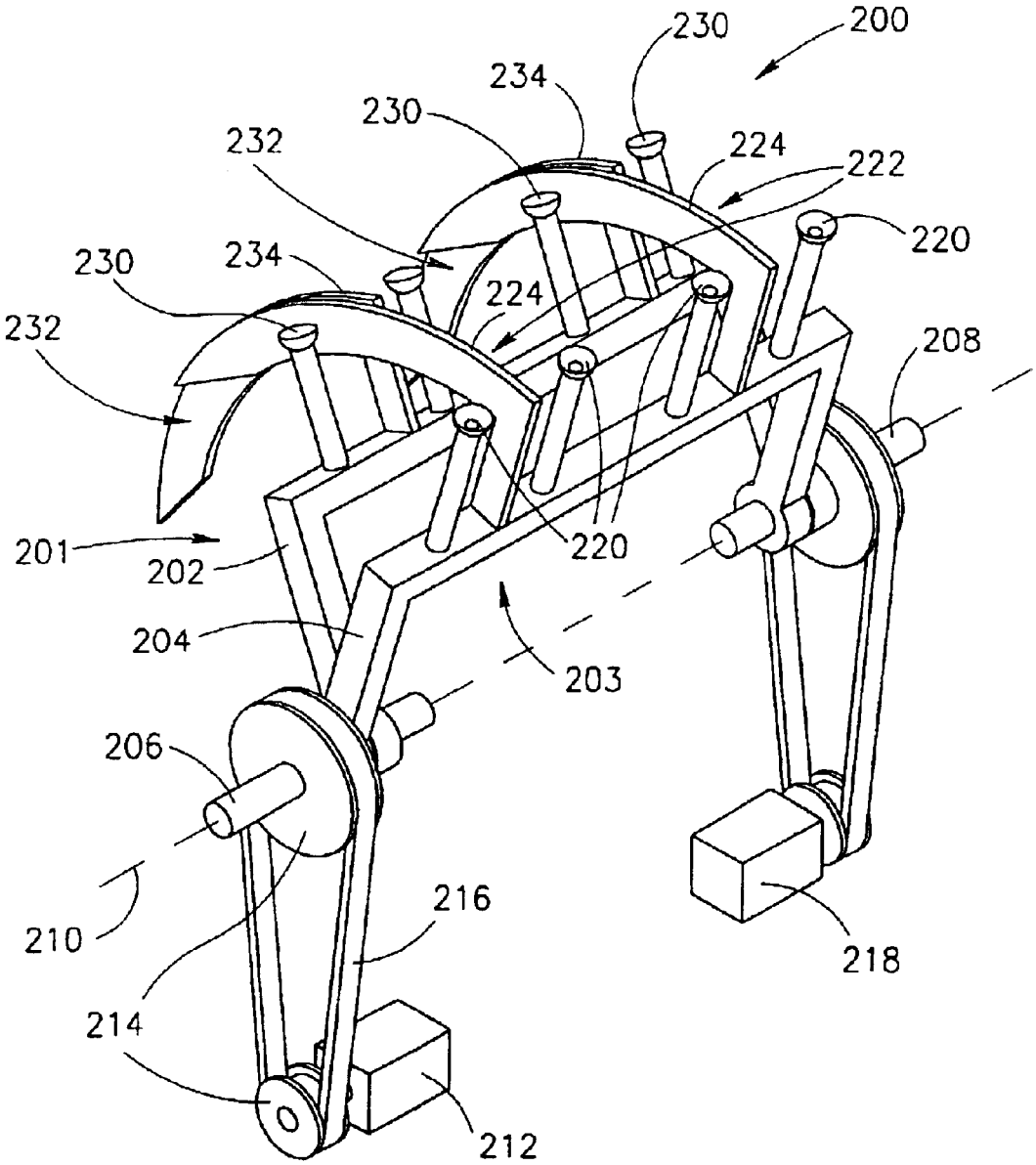

FIG. 4 schematically shows in a perspective view a perfector 200 for use with a duplex printing machine that prints both sides of a sheet on a same impression roller.

Perfector 200 preferably comprises two pick and place arms 201 and 203 preferably having bracket arms 202 and 204 respectively. Bracket arms 202 and 204 are rotatably mounted, preferably on two pin shafts 206 and 208, so that each bracket arm is independently rotatable about a same axis 210. Bracket arm 202 is preferably fixed to pin shaft 208 and rotatable about pin shaft 206. Similarly bracket arm 204 is preferably fixed to pin shaft 206 and rotatable about pin shaft 208.

Pin shaft 206 is coupled to a motor 212 preferably via pulleys 214 and a transmission belt 216. Preferably transmission belt 212 is a timing belt and pulleys 214 are splined pulleys. Bracket arm 204 rotates about axis 210 when motor 212 rotates pin shaft 206. Similarly, pin shaft 208 is coupled to a motor 218 that controls the rotation of pin shaft 208 and thereby the rotation of bracket arm 202 about axis 210.

Bracket arm 204 is mounted with a plurality of suction cups 220 and preferably at least two crescent structures 222 having sheet support surfaces 224. By way of example, bracket arm 204 is mounted with four suction cups 220 and two crescents 222. Preferably, a crescent 222 is mounted between each outer pair of suction cups 220. The radial distances of all suction cups 220 from axis 210 are preferably equal. Preferably, the radial distance of a region of a support surface 224 from axis 210 decreases slightly as the distance of the region from bracket arm 204 increases.

A channel inside bracket arm 204 communicates with suction cups 220 and is connected to a suitable vacuum system using methods known in the art, which controls aspiration of suction cups 220. Bracket arm 202 is preferably similarly mounted with suction cups 230 and crescents 232 having sheet support surfaces 234. Suction cups 230 and sheet support surfaces 234 lie on the same circularly cylindrical surface on which suction cups 220 and sheet support surfaces 224 lie. Crescent 222 and 232 are displaced from each other in a direction parallel to axis 210 so that bracket arms 204 and 202 can be rotated so that they are close to each other. When bracket arms 204 and 202 are close, crescents 222 interleave with crescents 232. The decrease in radial distance of regions of sheet support surfaces 224 and 234 prevents a sheet being held by one pick and place arm from being abraded by the sheet support surface of the other pick and place arm when the two pick and place arms are close together.

FIGS. 5A–5F schematically show side views of a sheet transport system 250 and illustrate its operation, in accordance with a preferred embodiment of the present invention. FIGS. 5A–5F show sheet transport system removing a sheet from an impression roller 252 of a printer (not shown) after a first side of the sheet is printed, turning the sheet over and returning the sheet to impression roller 252 for printing a second side of the sheet. A roller 254 represents any suitable device for printing an image on a sheet held on impression roller 252. Since the image on the two sides of the sheet are generally different, the printing device is preferably a digital printing device such as an electrophotographic device. Roller 254 may be, for example, an intermediate transfer member of a printer.

Figure 5A:
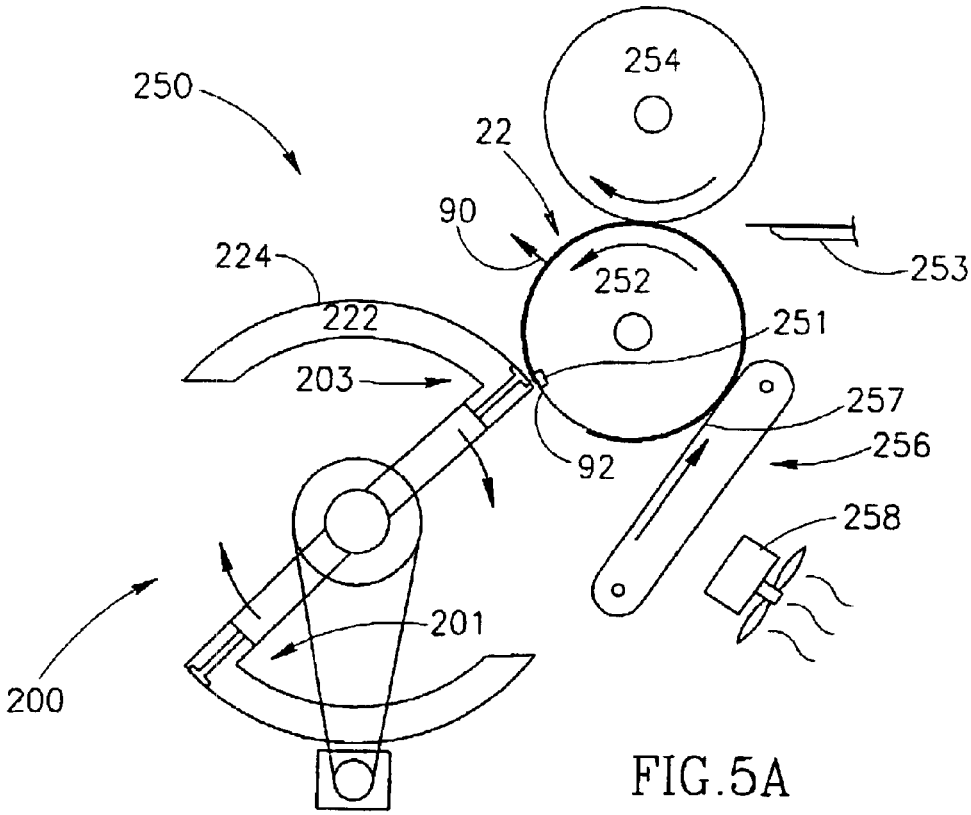
FIGS. 5A–5F show the operation of a re-feed perfector transport system comprising a perfector transporter similar to that shown in FIG. 4, in accordance with a preferred embodiment of the present invention.

Referring to FIG. 5A, sheet transport system 250 comprises the perfector 200 shown in a perspective view in FIG. 4, a conveyor belt 256 having a surface 257 and at least one fan 258. An arrow inside conveyor 256 indicates a direction of motion of surface 257. A first side of a sheet 22 is being printed on impression roller 252 as it rolls onto impression roller 252 from a feed tray 253. A gripper 251 on impression roller 252 holds a leading edge 92 of sheet 22. An arrow 90 indicates the printed side of sheet 22. Bold curved arrows on pick and place arms 201 and 203, hereinafter "arms 201 and 203", indicate direction of rotation of the arms, which are both moving clockwise. Suction cups 220 of pick and place arm 203 are approaching a hand off position between impression roller 252 and perfector 200.

At the handoff position suction cups 220 of arm are controlled to aspirate and grip leading edge 92. As arm 203 and impression roller 252 continue rotating after suction cups 220 grip leading edge 92, sheet 22 rolls off impression roller 252 and onto sheet support surfaces 224 of arm 203.

Figure 5B:
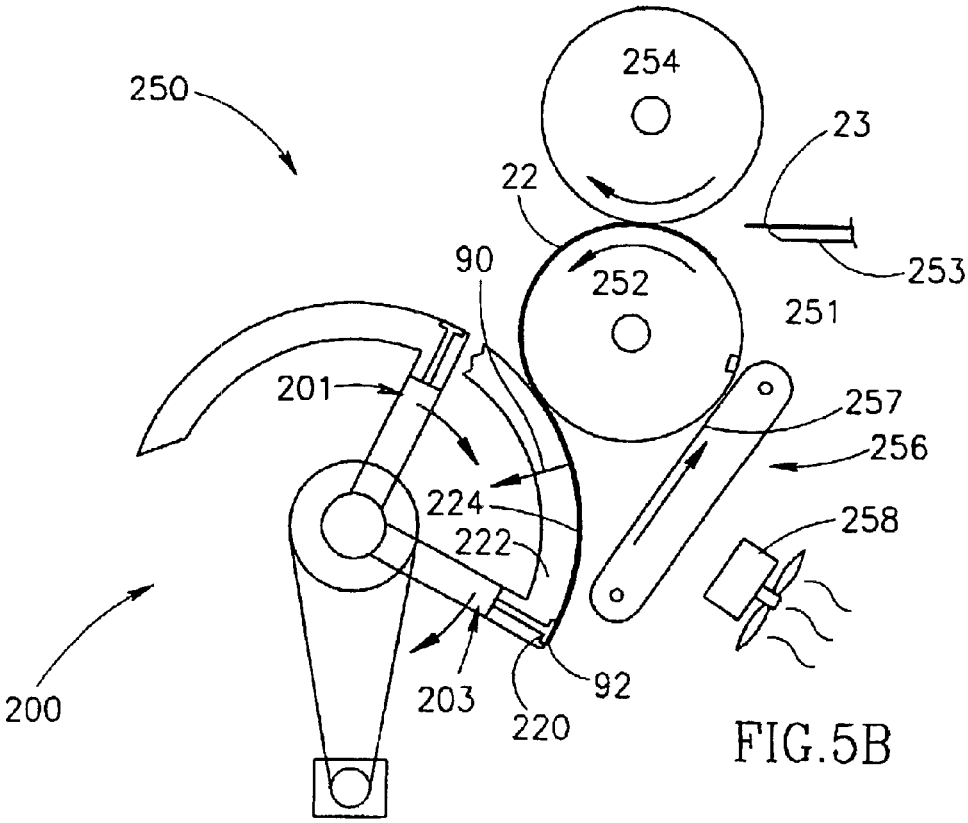

FIG. 5B shows transport system 250 after a substantial portion of sheet 22 has rolled onto sheet support surfaces 224 and a next sheet 23 is being fed to impression roller 252. Sheet support surfaces 224 contribute to a smooth roll off of sheet 22 from impression roller 252 and to reducing fluctuations in a force with which arm 203 pulls sheet 22 off impression roller 252. Support surfaces 224 also substantially reduce damage to sheet 22 from kinking or wrinkling of the sheet in regions near to suction cups 220. As arm 201 and impression roller 252 continue to rotate sheet 22 leaves impression roller 252 and is drawn by airflow created by fan 258 to conveyor surface 257.

Figure 5C:
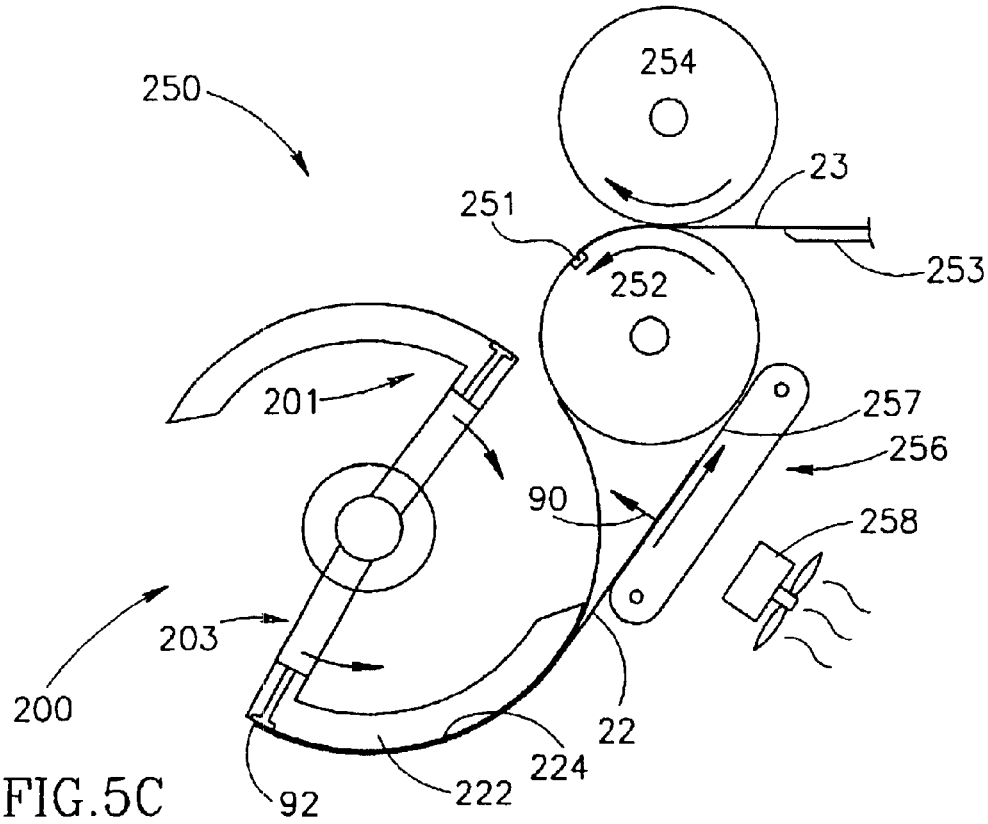

FIG. 5C shows sheet 22 and positions of arms 201 and 203 at a time at which sheet 22 has just rolled completely off impression roller 252 and lies flat on conveyor surface 257. At this time arm 201 reverses its direction of rotation so that it rotates counterclockwise and moves sheet 22 in the direction of motion of conveyor surface 257 so that a trailing edge 94 of sheet 22 approaches a hand off position between conveyor 257 and impression roller 252. Airflow from fan 258 and the motion of conveyor surface 257 substantially prevent "billowing" of sheet 22 on conveyor surface 257 and maintain relatively accurate registration of the position of trailing edge 94 to the position of leading edge 92.

Gripper 251 holds a leading edge of sheet 23 which is being printed on impression roller 252 and arm 201 is rotating clockwise to pick up the leading edge at the handoff position between impression roller 252 and perfector 200.

Figure 5D:
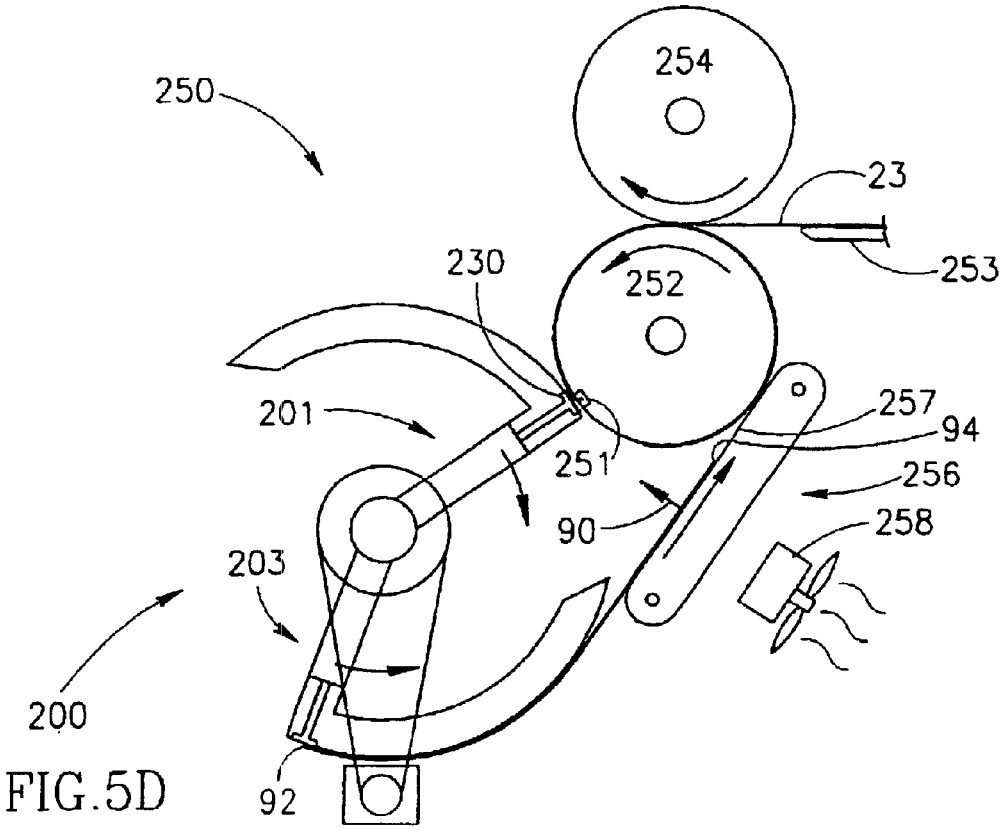

In FIG. 5D arm 201 is beginning to remove sheet 23 from impression roller 252 and suction cups 230 of arm 201 are gripping the leading edge of sheet 23 which is being released by gripper 251. Arm 203 is still moving counterclockwise and together with conveyor belt surface 257 are moving trailing edge 94 of sheet 22 to meet gripper 251.

Figure 5E:
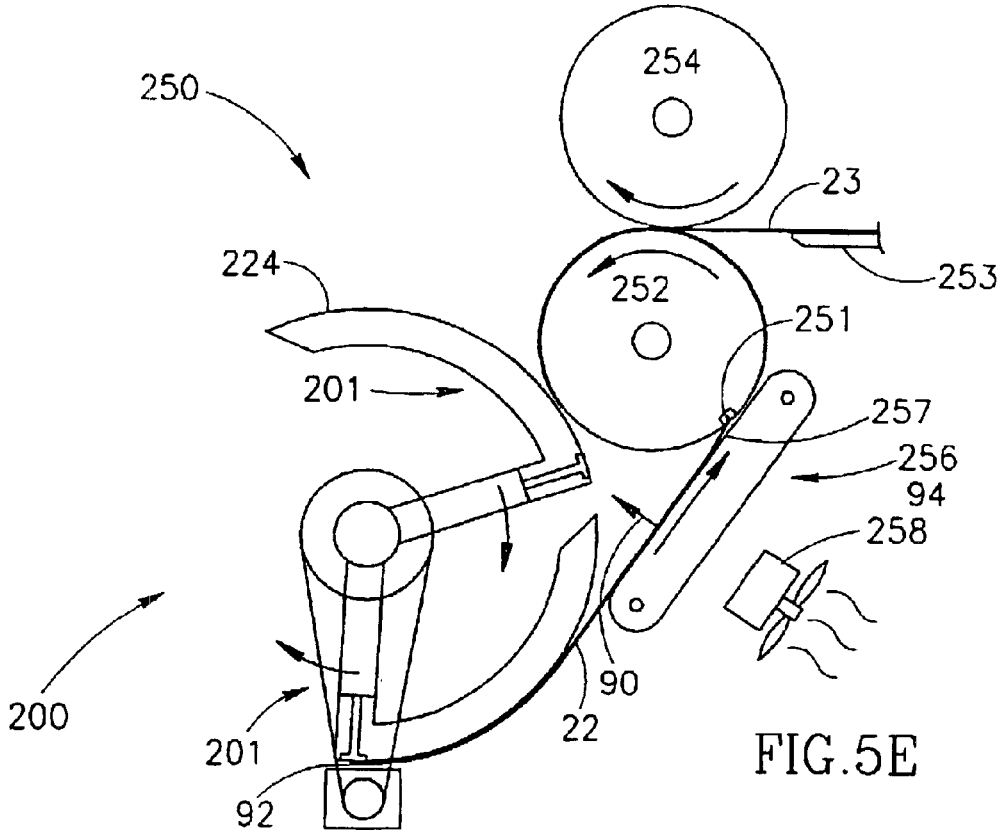

In FIG. 5E trailing edge 94 has reached the hand off position between conveyor surface 257 and impression roller 252. Gripper 251 is gripping trailing edge 94 of sheet 22 and sheet 22 is beginning to roll onto impression roller 252 with its first printed side face down on the roller. Suction cups 230 are releasing leading edge 92 of sheet 22 and arm 203 is reversing its direction of rotation so that it rotates clockwise and returns to impression roller 252 to pick up a next sheet from the impression roller. As sheet 22 rolls onto impression roller 252 its second side will be printed.

Figure 5F:
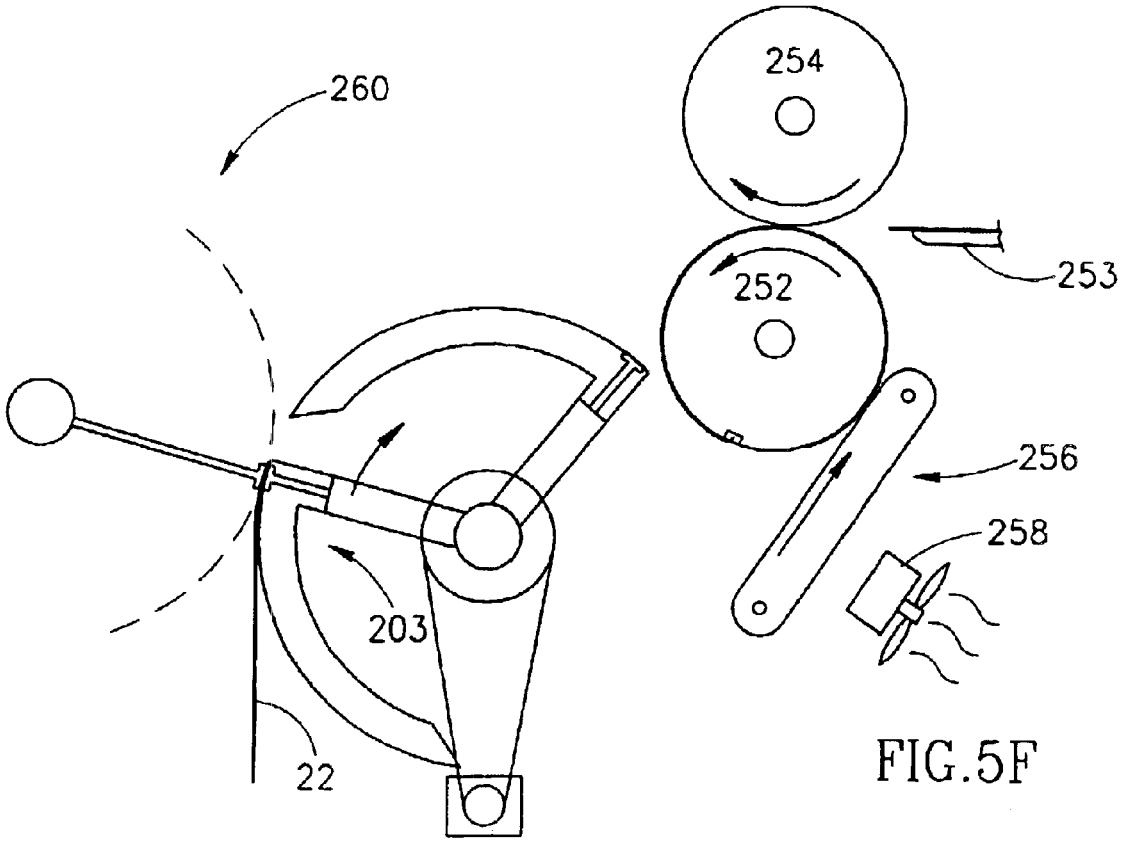

The next sheet that arm 203 removes from impression roller 252 is again sheet 22, but this time after the second side of sheet 22 is printed. Arm 203 does not of course return sheet 22 to impression roller 252 after the sheet's second side is printed. Instead of placing sheet 22 on conveyor surface 257 and reversing its direction of rotation from clockwise to counterclockwise arm 203 continues clockwise rotation and passes sheet 22 to a sheet transporter than moves sheet 22 towards an out tray. FIG. 5F shows arm 203 handing off sheet 22 after the second side of the sheet has been printed to a transporter 260 that moves the sheet towards an out tray.

It should be noted that a tandem sheet transport system, in accordance with a preferred embodiment of the present invention, removes sheets printed on a first impression roller of a tandem printer and feeds the sheets to a second impression roller of the printer as fast as they are printed so that a first side of a sheet is printed with every rotation of the impression roller. Similarly, a re-feed transport system, in accordance with a preferred embodiment of the present invention, comprised in a printing that prints both sides of a sheet on a same impression roller transports sheets at a rate such that a side of a sheet is printed with every rotation of the printer's impression roller.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of preferred embodiments thereof that are provided by way of example and are not intended to limit the scope of the invention. The described preferred embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

What is claimed is:

1. Apparatus for duplex printing comprising:

a first impression roller on which a first side of a sheet having a leading edge and a trailing edge is printed referenced to the leading edge;

a second impression roller on which a second side of the sheet is printed; and a transport system that removes a printed sheet from the first impression roller and transports it to the second impression roller, the transport system comprising a perfector including an element rotating about an axis, the element receiving the sheet and griping the sheet simultaneously along both the leading and trailing edges thereof, which rotating element turns the sheet over and transfers the sheet, trailing edge first, towards the second impression roller, wherein the perfector rotates in a first direction when removing the sheet from a preceding roller and rotates in an opposite direction when it passes off the sheet to a following roller.

2. Apparatus according to claim 1 wherein the perfector transfers the sheet with the trailing edge registered to the leading edge.

3. Apparatus according to claim 1 wherein the perfector comprises a first array of suction cups that grips the sheet adjacent the leading edge and a second array of suction cups that grips the sheet adjacent the trailing edge.

4. Apparatus according to claim 3 wherein the distance between the first and second suction cup arrays is adjustable to accommodate different size sheets.

5. Apparatus according to claim 3 wherein the perfector comprises a shaft to which the arrays of suction cups are mounted.

6. Apparatus according to claim 5 wherein the first and second arrays of suction cups are respectively connected via first and second internal channels in the shaft to at least one vacuum system that controls aspiration of suction cups in the arrays.

7. Apparatus according to claim 6 wherein the first and second channels respectively have first and second orifices on the surface of the shaft and wherein the first orifice is displaced from the second orifice along the axis of the shaft.

8. Apparatus according to claim 7 and comprising first, second and third annular bearings mounted to the shaft, wherein each bearing has an inner and outer race that sandwiches a plurality of rollers and a grease seal providing a seal between the inner and outer race.

9. Apparatus according to claim 8 wherein the first orifice is located between the first and second bearings and the second orifice is located between the second and third bearings.

10. Apparatus according to claim 9 wherein the shaft is sealed to the inner race of each bearing.

11. Apparatus according to claim 10 and comprising a housing mounted on the bearings, the housing having a housing wall formed with first and second through holes and having a cavity defined by a cavity surface, and wherein the first through hole is located between the first and second bearings and the second through hole is located between the second and third bearings.

12. Apparatus according to claim 11 wherein the outer race of each bearing is sealed to the cavity wall.

13. Apparatus according to claim 12 wherein the first and second through holes are connected to the at least one vacuum system via first and second pressure hoses respectively and wherein the suction cups of the first and second suction cup arrays aspirate when the at least one vacuum system respectively draws air through the first and second pressure hoses.

14. Apparatus according to claim 1 wherein the perfector comprises at least one sheet support surface on which the sheet lies when it is held by the perfector.

15. Apparatus according to claim 14 and comprising a fan that creates airflow that presses the sheet flat to the at least one sheet support surface.

16. Apparatus for duplex printing comprising:

a first impression roller on which a first side of a sheet having a leading edge and a trailing edge is printed referenced to the leading edge;

a second impression roller on which a second side of the sheet is printed; and a transport system that removes a printed sheet from the first impression roller and transports it to the second impression roller, the transport system comprising a perfector that receives the sheet and grips it along both the leading and trailing edges thereof, which perfector turns the sheet over and transfers the sheet, trailing edge first, towards the second impression roller, wherein the perfector rotates about in a first direction when removing the sheet from the preceding roller and rotates in an opposite direction when it passes off the sheet to a following roller.

17. Apparatus according to claim 16 wherein the perfector comprises an element that rotates about an axis and simultaneously grips both leading and trailing edges.

18. Apparatus according to claim 17 wherein the element rotates about in a first direction when removing the sheet from the preceding roller and rotates in an opposite direction when it passes off the sheet to a following roller.

19. Apparatus according to claim 16, wherein the transport system includes a second rotating element that receives the sheet from the element of the perfector and grips the originally trailing and presently leading edge of the sheet utilizing suction grippers.

* * * * *